US010322902B2

(12) United States Patent
Nakano

(10) Patent No.: US 10,322,902 B2
(45) Date of Patent: Jun. 18, 2019

(54) SHEET PROCESSING APPARATUS AND IMAGE FORMING APPARATUS HAVING THE SAME

(71) Applicant: Takahiro Nakano, Misato (JP)

(72) Inventor: Takahiro Nakano, Misato (JP)

(73) Assignee: CANON FINETECH NISCA INC., Misato-Shi, Saitama (JP)

( * ) Notice: Subject to any disclaimer, the term of this patent is extended or adjusted under 35 U.S.C. 154(b) by 0 days.

(21) Appl. No.: 15/783,550

(22) Filed: Oct. 13, 2017

(65) Prior Publication Data

US 2018/0111785 A1 Apr. 26, 2018

(30) Foreign Application Priority Data

Oct. 21, 2016 (JP) ..... 2016-206436
Oct. 21, 2016 (JP) ..... 2016-206437
Oct. 21, 2016 (JP) ..... 2016-206438

(51) Int. Cl.
*B65H 31/30* (2006.01)
*B42C 1/12* (2006.01)
(Continued)

(52) U.S. Cl.
CPC ..... *B65H 31/3063* (2013.01); *B42B 4/00* (2013.01); *B42C 1/125* (2013.01); *B65H 29/145* (2013.01); *B65H 31/02* (2013.01); *B65H 31/3027* (2013.01); *B65H 31/3081* (2013.01); *B65H 31/36* (2013.01); *B65H 43/00* (2013.01); *B65H 45/18* (2013.01); *G03G 15/6541* (2013.01);
(Continued)

(58) Field of Classification Search
CPC ..... B65H 29/145; B65H 31/02; B65H 31/24; B65H 31/36; B65H 31/38; B65H 31/3027; B65H 33/08; B65H 37/04; B65H 37/06; B65H 43/00; B65H 2301/1635; B65H 2301/4212; B65H 2301/4213; B65H 2301/42192; B65H 2301/42194; B65H 2403/942; B65H 2408/1222; B65H 2511/224; B65H 2511/30; B65H 2801/06; B65H 2801/27
USPC ..... 270/37, 58.01, 58.08, 58.12, 58.17
See application file for complete search history.

(56) References Cited

U.S. PATENT DOCUMENTS 5,112,034 A * 5/1992 Uto ..... B65H 29/60 270/58.12
7,192,020 B2 3/2007 Hayashi et al.
(Continued)

FOREIGN PATENT DOCUMENTS

CN 100335388 C 9/2007
CN 100557519 C 11/2009
JP 4298360 B2 7/2009

*Primary Examiner* — Leslie A Nicholson, III
(74) *Attorney, Agent, or Firm* — Manabu Kanesaka

(57) ABSTRACT

Disclosed herein is a sheet processing apparatus comprising a sheet tray configured to hold a bundle composed of the sheets fed from conveyance rollers, a wait path configured to keep waiting following sheets upstream the conveyance rollers, an accumulating tray configured to hold a sheet bundle, delivery rollers configured to nip the sheet bundle mounted on the sheet tray and the following sheets, to set off from one another, and to deliver them to the accumulating tray, and to switch back the following sheets to the sheet tray, and a conveyance member configured to convey the following sheets from the sheet tray.

13 Claims, 23 Drawing Sheets

(51) Int. Cl.

| | |
|---|---|
| ***G03G 15/00*** | (2006.01) |
| ***B65H 29/14*** | (2006.01) |
| ***B65H 31/02*** | (2006.01) |
| ***B65H 31/36*** | (2006.01) |
| ***B65H 43/00*** | (2006.01) |
| ***B65H 45/18*** | (2006.01) |
| ***B42B 4/00*** | (2006.01) |

(52) U.S. Cl.

CPC ..... *B65H 2301/4212* (2013.01); *B65H 2301/4213* (2013.01); *B65H 2301/42194* (2013.01); *B65H 2301/42262* (2013.01); *B65H 2403/942* (2013.01); *B65H 2404/147* (2013.01); *B65H 2404/1521* (2013.01); *B65H 2405/11151* (2013.01); *B65H 2511/152* (2013.01); *B65H 2511/22* (2013.01); *B65H 2511/30* (2013.01); *B65H 2701/131* (2013.01); *B65H 2701/1311* (2013.01); *B65H 2701/1313* (2013.01); *B65H 2801/24* (2013.01); *B65H 2801/27* (2013.01)

(56) References Cited

U.S. PATENT DOCUMENTS

| | | | | |
|---|---|---|---|---|
| 7,354,036 | B2 | 4/2008 | Hayashi et al. | |
| 7,540,482 | B2 * | 6/2009 | Fujii | B65H 29/51 270/58.08 |
| 7,552,917 | B2 | 6/2009 | Hayashi et al. | |
| 7,946,563 | B2 * | 5/2011 | Fukasawa | G03G 15/6582 270/32 |
| 7,975,999 | B2 * | 7/2011 | Fukasawa | B65H 37/04 270/32 |
| 9,045,308 | B2 * | 6/2015 | Tamura | G03G 15/6547 |
| 9,329,555 | B2 * | 5/2016 | Motoi | B65H 29/60 |

* cited by examiner

SHEET PROCESSING APPARATUS AND IMAGE FORMING APPARATUS HAVING THE SAME

BACKGROUND OF THE INVENTION

1. Field of the Invention

This invention relates to a sheet processing apparatus for processing sheets, and to an image forming apparatus, more particularly to a technique of improving the alignment of sheets temporarily placed on a sheet tray.

2. Description of the Related Art

Some of the image forming apparatuses for use in copiers, laser-beam printers, facsimiles and composite apparatuses, each comprising these, have a sheet processing apparatus that performs a sheet processing such as binding sheets each having an image formed on it.

In such an image forming apparatus, the sheet processing apparatus will make an untidy sheet bundle if the sheets are not aligned on the sheet tray. The untidy sheet bundle must be unbundled and bundled again. Therefore, it is important to align the sheets well in the sheet processing apparatus.

It is recently demanded that the sheet processing apparatus should hold many sheets and process them at high speed. An apparatus that may meet this demand is disclosed in Japanese Patent No. 4,298,360 (corresponding to U.S. Pat. No. 7,192,020 B2 and to Chinese Patent 100335388 C, hereinafter referred to as "patent documents"). This apparatus, shown in FIG. 22 attached thereto, is a sheet processing apparatus BO to be incorporated into image forming apparatuses. In the sheet processing apparatus BO, a relatively large number of sheets are placed on the sheet tray T, bound together in the binding unit TSP and delivered, in the form of a bundle, by the delivery rollers R onto the accumulating tray AT. The sheet processing apparatus comprises a saddle-binding tray NT and a saddle-binding unit NSP. The saddle-binding tray NT branches from the conveyance path at the inlet port of the apparatus. The saddle-binding unit NSP binds sheets at the middle part of the saddle-binding tray NT.

In this apparatus, while the binding unit TSP is binding the sheets placed on the sheet tray T, the following sheets are kept waiting at a standby tray BT so that they may be processed in a large number and at high speed. The standby tray BT (generally called "buffer tray") is designed to keep one to three sheets waiting. While the sheets are so kept waiting, the sheets on the sheet tray T are bound together, forming a bundle.

As shown in FIG. 23A, the sheet bundle BP and the bundle of the following sheets are conveyed from the sheet tray T and the standby tray BT, respectively, with a prescribed offset, are nipped at delivery rollers R (i.e., upper delivery roller R1 and lower delivery roller R2), and are delivered onto the accumulating tray AT. The sheet bundle BP is thereby fed from the delivery rollers R and mounted on the accumulating tray AT.

Meanwhile, the following sheets (WP1 to WP3) are nipped by the delivery rollers R. At this time, the delivery rollers R are stopped for some time and then rotated in the reverse direction. The following sheets are thereby switched back above the sheet tray T and then placed on the sheet tray T. This method of delivering the sheets is generally called "simultaneous bundle delivering", and enhances the speed of delivering the following sheets from the standby tray BT. Ultimately, the apparatus can operate at high speed.

In the apparatus disclosed in the above-identified patent document, the last following sheet WP3 is set nearer to the front end of the sheet bundle BP than the other following sheets WP1 and WP2 by distance wp11. This is because the following sheets may be conveyed in wrong order as the delivery rollers R rotate, and such wrong-order conveyance must be prevented. (See FIG. 47 of the above-identified patent document.)

SUMMARY OF THE INVENTION

In the apparatus disclosed in the above-identified patent document, only the third following sheet is set off toward the front end of the sheet bundle. Therefore, when 50 to 70 sheets are mounted, forming a bundle BP as shown in FIG. 23B, the delivery rollers R pull out the sheet bundle BP, and the upper delivery roller R1 moves up around the fulcrum RP of the roller arm RA, toward the sheet tray T (located upstream). As the upper delivery roller R1 moves so, the following sheet WP3, which contacts the upper delivery roller R1, greatly moves in the direction of arrow PM.

Thus, the uppermost following sheet WP3 contacting the upper delivery roller R1 moves to the right as shown in FIG. 23B. As the uppermost following sheet WP3 moves so, the second following sheet WP2 may deviate rightward from the following sheet WP1 and may not be corrected in position by gathering roller KR which arranged at the front end of the sheet tray T. In other words, the last following sheet may fail to lie leftmost and may lie rightmost instead. If this happens, the uppermost following sheet wp3 fed by the gathering roller KR will abut on the front-end stopper KJ. In this case, the following sheets WP2 and WP1 lying below the following sheet WP3 fail to reach the front-end stopper KJ and may not be aligned with the following sheet WP3 on the sheet tray T.

If there are two following sheets, they may be set off by a longer distance wp11. In this case, however, they will move too much, and it will take a long time to align them or they will not be aligned at all.

In view of the above, the object of this invention is to provide a sheet processing apparatus and an image forming apparatus, in which the offset distance of the following sheets is changed in accordance with the thickness of the sheet bundle (i.e., number of sheets forming the bundle) mounted on the sheet tray, thereby reducing the erroneous alignment of sheets, regardless of the thickness of the sheet bundle.

To achieve the above-mentioned object, there is provided a sheet processing apparatus which comprises: conveyance rollers configured to convey sheets in a prescribed conveyance direction; a sheet tray configured to collect the sheets conveyed from the conveyance rollers, thereby forming a sheet bundle, and to hold the sheet bundle at a prescribed position; a wait path provided upstream in the conveyance direction of the conveyance rollers, and configured to keep waiting the following sheets conveyed by the conveyance rollers; second conveyance rollers configured to cooperate with the conveyance rollers to make following sheets wait in the wait path and to convey the following sheet from the wait path; an outlet port configured to deliver the sheet bundle from the sheet tray in a prescribed direction; an accumulating tray configured to receive the sheet bundle delivered from the outlet port; delivery rollers configured to nip the sheet bundle mounted on the sheet tray and a plurality of following sheets including the following sheet conveyed from the wait path, while setting off the following sheets by a prescribed offset distance, to deliver the sheet bundle through the outlet port onto the accumulating tray, and to switch back the plurality of following sheets onto the sheet tray; and a conveyance member configured to convey the following sheets from the sheet tray toward the prescribed position. The offset distance between the following sheets nipped together with the sheet bundle is changed in accordance with the thickness of the sheet bundle delivered by the delivery rollers.

The configuration described above can provide a sheet processing apparatus and an image forming apparatus in which the offset distance between the following sheets is changed in accordance with the thickness of the sheet bundle (number of sheets forming a sheet bundle) mounted on the sheet tray, thereby reducing the erroneous alignment of sheets, regardless of the thickness of the sheet bundle.

BRIEF DESCRIPTION OF THE DRAWINGS

FIGS. 9A and 9B are diagrams explaining the process following the process of FIGS. 8A and 8B, FIG. 9A showing how the first sheet bundle BP1 is delivered from the sheet tray, while the following sheets wp1 to wp3 left on the sheet tray are switched back, and FIG. 9B showing how the first sheet bundle BP1 is placed in the accumulating tray, how the second sheet bundle BP2 is placed in the sheet tray, and how the seventh following wp1 is conveyed in;

FIG. 11A showing how the first sheet wp1 of the second bundle is guided, as waiting sheet, into the branch path, and FIG. 11B showing how the second following sheet wp2 of the second bundle is guided into the branch path;

DESCRIPTION OF THE EMBODIMENTS

Figure 1:
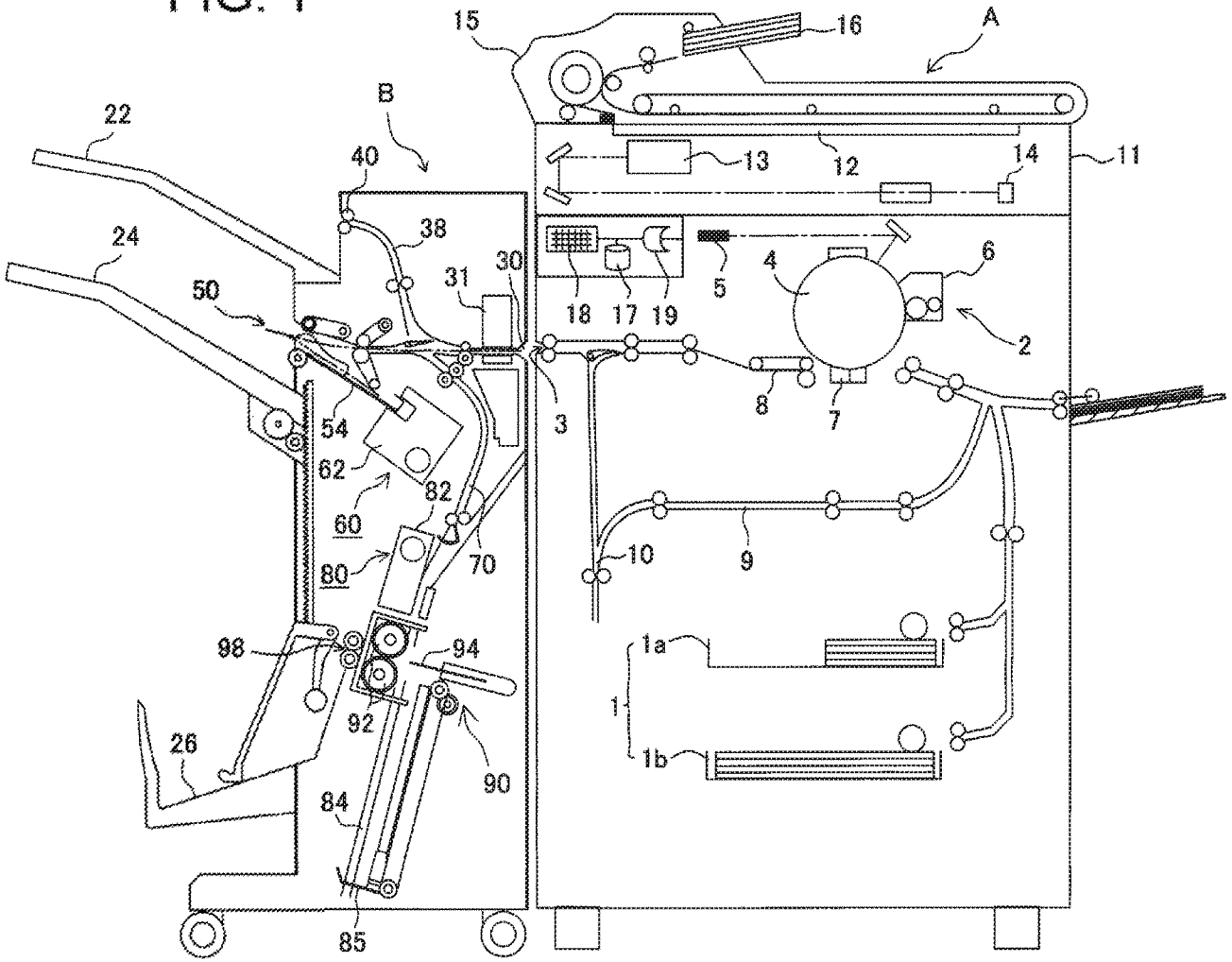
FIG. 1 is a diagram showing the overall configuration of a combination of an image forming apparatus and a sheet processing apparatus, both according to the present invention.
Figure 2:
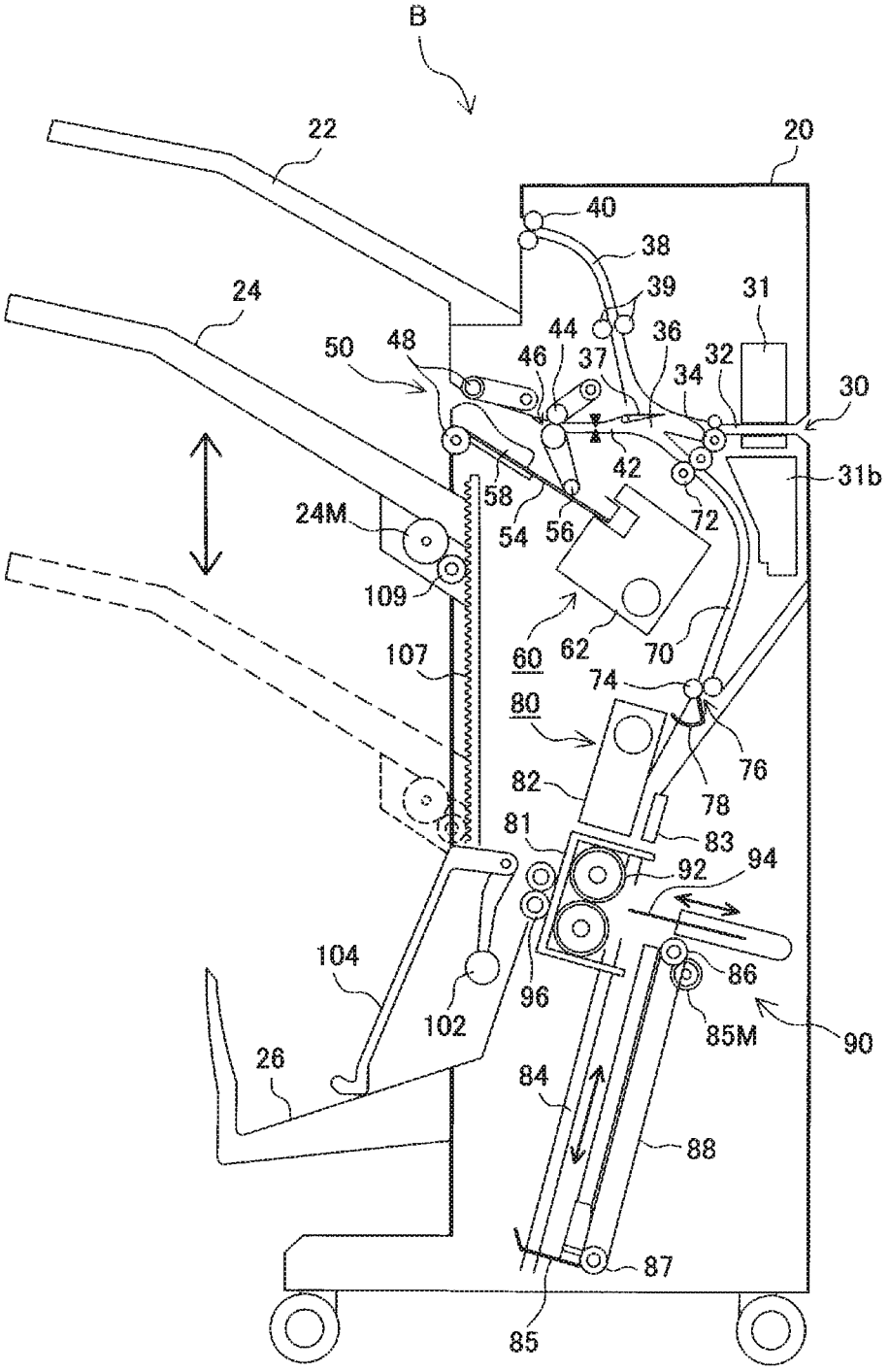
FIG. 2 is a diagram showing the overall configuration of the sheet processing apparatus according to the present invention.

Embodiments of the present invention will be described, with reference to the accompanying drawings. FIG. 1 shows an image forming system comprising an image forming apparatus A and a sheet processing apparatus B, both according to this invention. FIG. 2 is a diagram showing, in detail, the configuration of the sheet processing apparatus B.

In the drawings attached hereto, the components of an embodiment, which are similar to those of any other embodiment, shall be designated by the same reference numerals.

[Image Forming System]

The image forming system shown in FIG. 1 comprises an image forming apparatus A and a sheet processing apparatus B. The sheet inlet port 30 of the sheet processing apparatus B is connected to the outlet port 3 of the housing of the image forming apparatus A. The sheets, each having an image formed on it in the image forming apparatus A, can be staple-bound in the sheet processing apparatus B and can be stored in the first accumulating tray 24 or in the second accumulating tray 26. Above the first accumulating tray 24, an escape tray 22 is arranged to hold sheets not bounded.

[Image Forming Apparatus A]

The image forming apparatus A will be described with reference to FIG. 1. In the image forming apparatus A, a sheet is supplied from the sheet supplying unit 1 to the image forming unit 2. In the image forming unit 2, an image is formed on the sheet, and the sheet is delivered through the sheet delivering port 3 made in the housing. The sheet supplying unit 1 has sheet cassettes 1*a* and 1*b*. The sheet cassette 1*a* hold sheets of one size, and the sheet cassette 1*b* holds sheets of another size. The sheets of the size designated are supplied, one by one, to the image forming unit 2.

The image forming unit 2 incorporates, for example, an electrostatic drum 4, a printing head (i.e., laser-beam emitter) 5, a developing device 6, a transfer charger 7, and a fixing device 8. In the image forming unit 2, the laser-beam emitter 5 forms a latent electrostatic image on the electrostatic drum 4, and the developing device 6 applies toner to the electrostatic drum 4, forming a toner image. The transfer charger 7 transfers the toner image to a sheet. The fixing device 8 applies heat to the sheet, fixing the image on the sheet. The sheets, each having an image so fixed, are sequentially delivered through the fixing device 8. Numeral 9 indicates a circulating path, in which a sheet having an image printed on the obverse side is turned upside down while passing through a switch back path 10 and is delivered again to the image forming unit 2 to be printed on the reverse side. The sheet printed on both sides is turned upside down again in the switch back path 10 and is delivered through the sheet delivering port 3 of the image forming apparatus A.

Numeral 11 indicates an image reading device, in which a scanning unit 13 scans the original sheet set on a platen 12, and a photoelectric transducer (e.g., CCD) 14 electrically reads the image from the original sheet. The image data read from the original sheet is digital-processed in, for example, an image processing unit. The digital data generated in an image processing unit is transferred to a data storing unit 17 and then to the laser-beam emitter 5. Numeral 15 indicates an original feeder, which feeds original sheets from an original stacker 16 to the platen 12.

Figure 17:
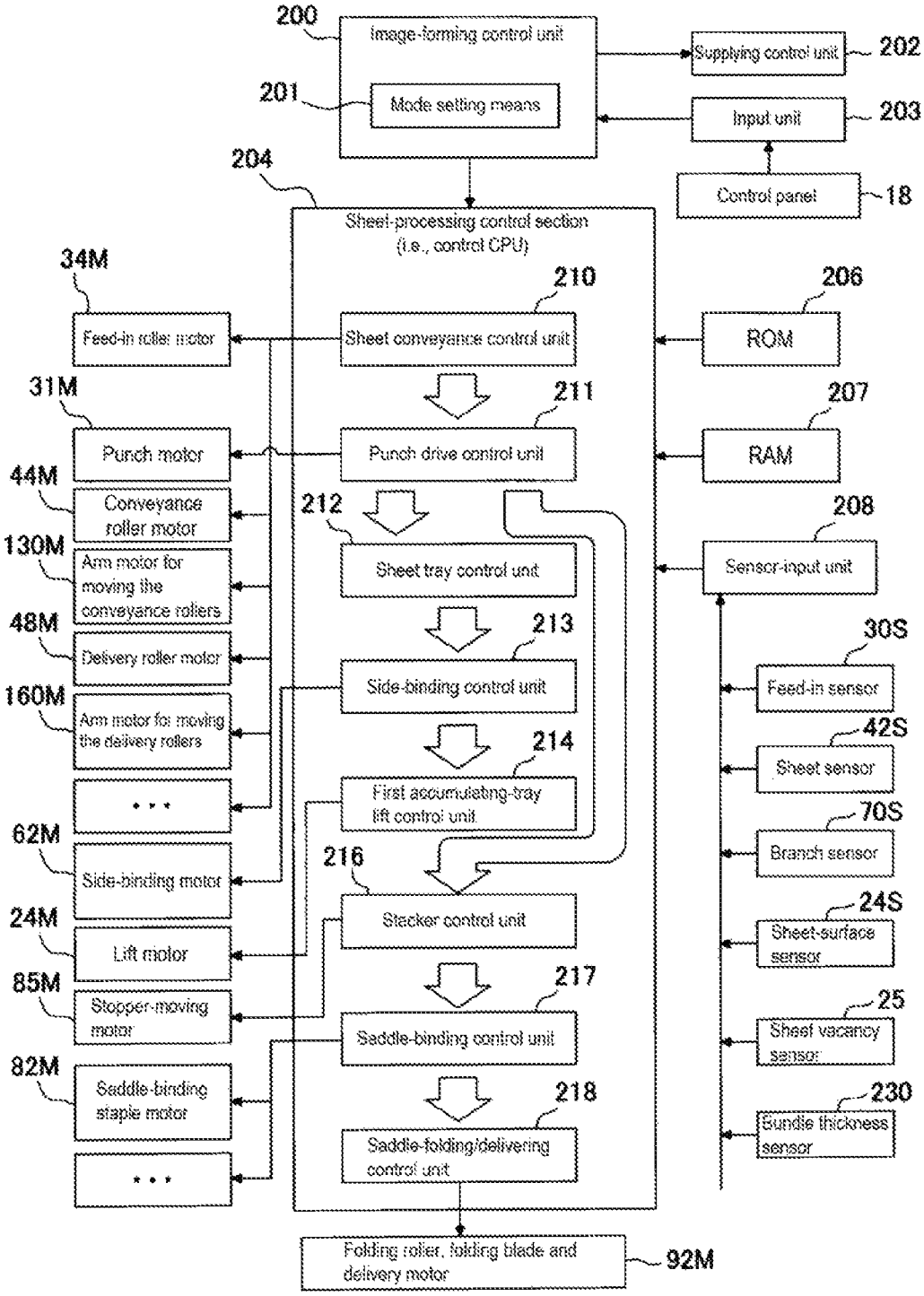
FIG. 17 is a block diagram of the control system used in the apparatus shown in FIG. 1.

As shown in FIG. 17, the image forming apparatus A has an image-forming control unit 200. The image-forming control unit 200 receives various image-forming conditions through a control panel 18 via an input unit 203. The image-forming conditions include, for example, sheet-size, and the printing conditions include, for example, color/monochrome print, number of prints, single-side/double side printing, and enlarged/reduced printing. In the image forming apparatus A, the data storing unit 17 stores the image data read by the scanning unit 13 or the image data transferred from any external network. The image data is transferred from the data storing unit 17 (see FIG. 1) to a buffer memory 19. Data signals are sequentially supplied from the buffer memory 19 to the laser-beam emitter 5.

At the control panel 18, sheet-processing modes are designated, along with the image-forming modes such as single-side/double side printing, enlarged/reduced printing, color/monochrome printing. The sheet-processing modes are, for example, "print-out mode", "side-binding mode", "jog-delivering mode" and "saddle-binding mode". The sheet-processing modes will be described later.

[Sheet Processing Apparatus B]

As shown in FIG. 1 and FIG. 2, the sheet processing apparatus B incorporates a sheet inlet port 30 made in one frame 20 and the escape tray 22 provided on the side opposing the sheet inlet port 30. The escape tray 22 holds one sheet or a relatively thick sheet. Below the escape tray 22, the first accumulating tray 24 is positioned, which can move up and down and can hold side-bound sheets or a relatively large number of sheets. Below the first accumulating tray 24, the second accumulating tray 26 is provided to accumulate side-bound sheets or folded sheets. In this invention, the word "side" means the surfaces around any sheet end, namely the obverse and reverse sides at sheet edges. Hence, the side-binding processing indicates the binding of an end of a sheet bundle.

[Sheet Conveyance Path]

The sheet processing apparatus B has a feed-in path 32 and a conveyance path 42. The conveyance path 42 extends from the above-mentioned sheet inlet port 30, namely from the feed-in path 32, to the outlet port (sheet-delivering port) 50 of the sheet tray. In the feed-in path 32, a punching unit 31 is provided to punch the sides of a sheet and, if necessary, that part of a sheet, which is middle in the conveyance direction. Below that part of the punching unit 31, which lies below the above-mentioned feed-in path 32, a punch-chip box 31*b* is provided, detachably secured to the frame 20 of the apparatus B, to receive punch chips made in the punching process.

Downstream the punching unit 31, feed-in rollers 34 are arranged to feed sheets at a relatively high speed. In the conveyance path 42 located below the feed-in rollers 34, a sheet tray 54 and conveyance rollers 44 are provided. The sheet tray 54 is the first processing tray, and the conveyance rollers 44 can rotate in forward direction and reverse direction to guide sheets to the first accumulating tray 24 located downstream of the sheet tray 54. At the back of the conveyance rollers 44, a sheet-conveyance outlet port 46 is provided.

Downstream of the sheet-conveyance outlet port 46, delivery rollers 48 are provided. The delivery rollers 48 switch back a sheet and then deliver the sheet onto the sheet tray 54, deliver the sheet directly onto the first accumulating tray 24, or deliver a sheet bundle formed by side-binding the sheets on the sheet tray 54, from the sheet tray 54 to the first accumulating tray 24. Further, the delivery rollers 48 can perform jog-delivering to shift a sheet bundle without binding the sheets at the sheet tray 54 and to sort sheet bundles at the first accumulating tray 24.

[Escape Path and Branch path]

The conveyance path 42 is branched at a branch position 36 into an escape path 38 and a branch path 70. The escape path 38 guides sheets to the escape tray 22. The branch path 70 guides relatively long sheets to a stacker 84. The stacker 84 is the second processing tray (i.e., second sheet tray) at which relatively long sheet may be saddle-bound or folded. At the branch position 36, a switching gate 37 is provided to convey a sheet directly to the conveyance path 42 or to the escape path 38, or to switch back a sheet in the conveyance path 42 and then guide the sheet to the branch path 70.

Figure 3:
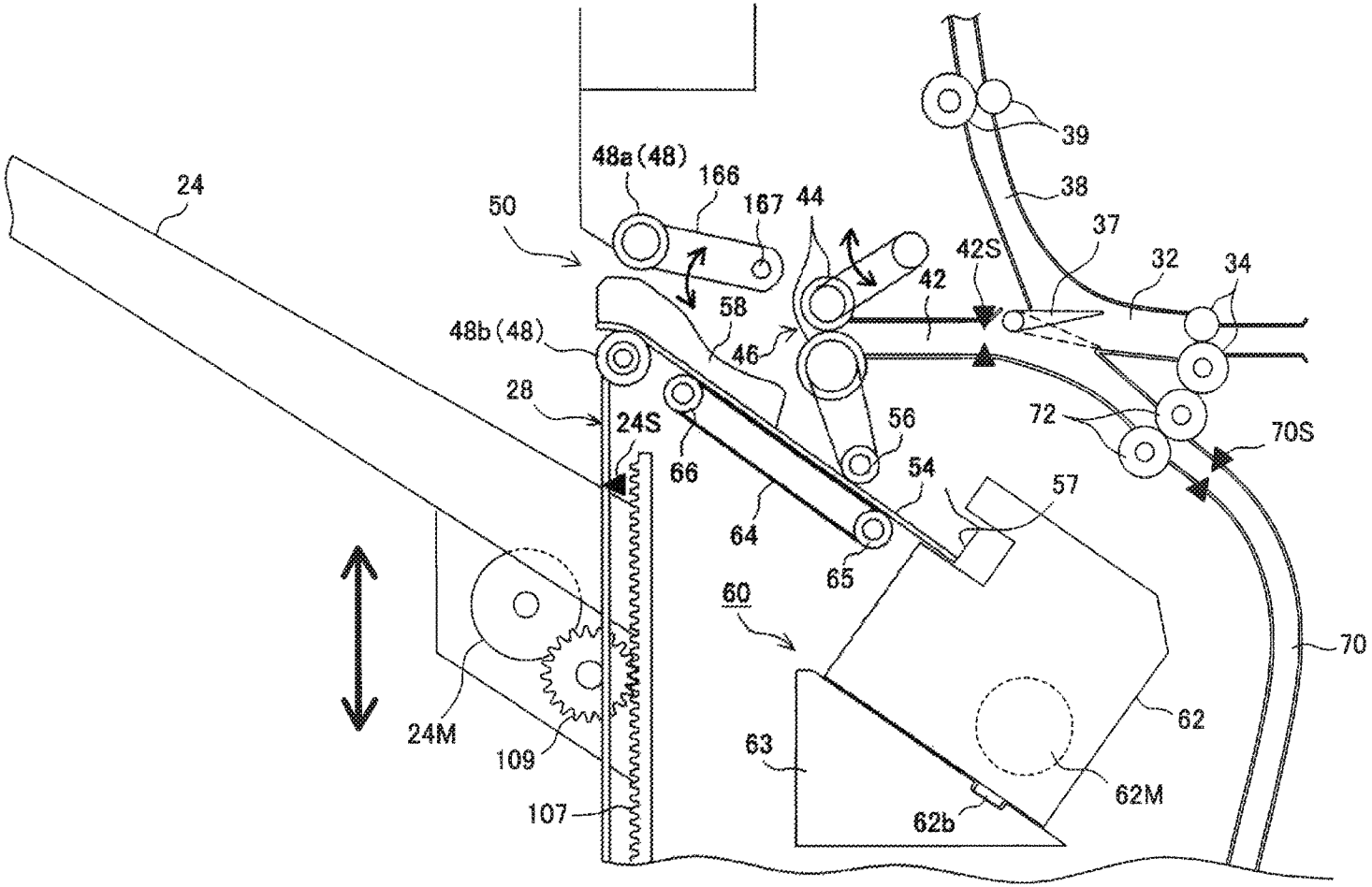
FIG. 3 is an enlarged side view of the sheet tray (i.e., first processing tray) incorporated in the sheet processing apparatus.

As shown in FIG. 2 and FIG. 3, the branch path 70 is a path curved downward, surrounding the sheet tray 54 at one side thereof. The branch path 70 is used as a wait path in which any following sheet switched back is kept waiting as will be described later in detail. In the escape path 38, escape rollers 39 and escape delivery rollers 40 are provided. The escape rollers 39 convey a sheet, and the delivery rollers 40 deliver a sheet to the escape tray 22.

[Side-Binding Unit]

Below the sheet-conveyance outlet port 46 of the conveyance path 42, the sheet tray 54 (i.e., first processing tray) is arranged. Below the sheet tray 54, a side-binding unit 60 is provided to bind the sides of any sheet temporarily mounted on the sheet tray 54. The side-binding unit 60 will be described later, with reference to FIG. 3 and FIG. 5.

[Saddle-Binding Unit]

Relatively long sheets are first conveyed in the conveyance path 42 toward the sheet tray 54, then conveyed to the downstream side of the switching gate 37, next switched back to the branch path 70, then conveyed from a branch outlet port 76, and collected in the stacker 84, i.e., second sheet tray. Near the stacker 84, a saddle-binding unit 80 is arranged. The saddle-binding unit 80 is configured to bind the sheets collected in the stacker 84, at part middle in the conveyance direction. As shown in FIG. 2, a flapper 78 is provided at the branch outlet port 76. Every time a sheet is supplied from branch delivery rollers to the stacker 84, the flapper 78 biases the sheet to the left, preventing the rear end of the sheet from abutting on the front end of the following sheet.

[Stacker (i.e., Second Sheet Tray)]

To the stacker 84, a stopper 85 is secured to hold a sheet at the position where the sheet should be fed in. The stopper 85 is moved in the direction of the arrow if a stopper-moving motor 85M drives a belt 88 wrapped around upper and lower pulleys 86, 87 at one side of the stacker 84. The stopper 85 can be held at the position where the flapper 78 may change the position of the rear end of the sheet delivered into the stacker 84, at the position where the saddle binder 82 performs saddle binding on sheets, binding the sheets together, at the part middle in the conveyance direction, and at the position where a folding blade 94 that makes reciprocating motion is pushed into the nip between a pair of holding rollers 92, thereby to hold a sheet bundle double. Two alignment plates 81 are provided above one folding roller 92 and below the other folding roller 92, respectively, to align each sheet conveyed into the stacker 84 with those already held in the stacker 84.

[Saddle-Binding Unit]

The saddle-binding unit 80 has an anvil 83 that opposes a driver provided in the saddle binder 82. The anvil 83 is configured to bend the leg parts of a stable driven by the driver. The saddle binder 82 is a well-known type, and will not be described here. The saddle-binding unit may not be limited to one that drives a stable through a sheet bundle, thereby binding the sheets together. Rather, it may be a mechanism that applies adhesive to each sheet at part middle in the conveyance direction and then bonds the sheets together.

[Second Sheet Tray]

The sheet bundle, saddle-bound at the saddle binder 82, is folded double by the folding roller 92 and the folding blade 94 pushing the sheet bundle. While being so folded, the sheet bundle is delivered onto the second accumulating tray 26 by the folding roller 92 and the bundle-delivery rollers 96 located downstream the folding roller 92. To the front end of the second accumulating tray 26, onto which the sheet bundle folded double and being delivered first at the front end may be dropped, free-rotatable rollers, a rotatable holding roller 102 and a holding lever 104 are secured. The lever 104 touches the upper side of a sheet bundle, preventing the sheets from moving sideways. The rotatable holding roller 102 and a holding lever 104 loosen the sheet bundle, lowering the sheet-bundling efficiency.

[Branch Position and Side-Binding Unit]

The branch position 36 and the side-binding unit 60 will be further described with reference to FIG. 3. As described above, FIG. 3 shows the feed-in path 32, conveyance path 42, escape path 38 and branch path 70. In the feed-in path 32, the feed-in rollers 34 have been inserted though the sheet inlet port 30. The conveyance path 42 extends straight from the feed-in path 32 toward the sheet tray 54. The escape path 38 extends upward from the conveyance path 42 as shown in FIG. 3. The branch path (i.e., wait path) curves downward and guides a sheet to the stacker 84. At the branch position 36, the switching gate 37 is provided to guide the sheet switched back from the escape path 38 or conveyance path 42, to the branch path 70.

In this embodiment, the switching gate 37 may assume the position indicated by solid lines in FIG. 3 to close the escape path 38, thereby to guide the sheet into the conveyance path 42 from the feed-in path 32. The switching gate 37 may assume the position indicated by broken lines in FIG. 3, thereby to guide the sheet transported from the feed-in path 32, to the escape path 38, and to guide the sheet to switch back, to the branch path 70.

In the conveyance path 42, the conveyance rollers 44 are arranged immediately before the sheet-conveyance outlet port 46, which is the final end and can rotate in forward direction and reverse direction and can contact and leave each other. Therefore, the conveyance rollers 44 can convey a sheet toward the sheet tray 54 if they contact and rotate in one direction, and can switch back a sheet toward the branch path (wait path) 70 located in the opposite direction if they contact and rotate in the other direction.

[Switch-Back Conveyance]

The switch-back conveyance is performed by rotating the conveyance rollers 44 in the reverse direction after the sheet sensor 42S arranged at the back of the switching gate 37 provided in the conveyance path 42 detects the passing of the rear end of a sheet. If the conveyance rollers 44 are rotated in the reverse direction, the switching gate 37 is positioned, closing the feed-in path 32 (see the broken lines in FIG. 3). The sheet is therefore transported to the branch path 70 and further transported by branch rollers 72 (i.e., second conveyance rollers). When the rear end of the sheet reaches a prescribed position, the branch rollers 72 are stopped, making the sheet wait in the branch path 70 as a following sheet.

The branch rollers 72 thus cooperate with the conveyance rollers 44, making one sheet to a few sheets wait in the branch path 70.

The delivery rollers 48 are arranged in the outlet port 50 (i.e., sheet-delivering port of the sheet tray 54) located downstream the conveyance rollers 44. The delivery rollers 48 rotate forward and backward and come into contact with and separated from each other. The delivery rollers 48 are an upper delivery roller 48*a* and a lower delivery roller 48*b*. These rollers 48*a* and 48*b* may contact each other and rotate in one direction to cooperate with the conveyance rollers 44, thereby to deliver a sheet onto the first accumulating tray 24. The delivery rollers 48 are used to deliver the sheet bundle from the sheet tray 54 onto the first accumulating tray 24 after the sheet bundle has been pushed out onto the first accumulating tray 24 by a pushing member that has a reference surface 57.

[Delivery onto the Sheet Tray 54]

How to deliver a sheet onto the sheet tray 54 will be explained. To deliver a sheet onto the sheet tray 54, the delivery rollers 48 located downstream are rotated in reverse direction, conveying a sheet from the conveyance rollers 44 to the right on the inclined surface of the sheet tray 54 as shown in FIG. 3. The sheet is further conveyed as a rotating gathering roller 56 is rotated in the counterclockwise direction. The sheet abuts on the reference surface 57 and is stopped. At this point, the gathering roller 56 slips on the sheet, preventing the sheet, as much as possible, from bending at the front part. The delivery rollers 48 have the function of switching back the sheet delivered from the conveyance rollers 44 and transporting the sheet to the reference surface 57 of the sheet tray 54.

[Moving of the Side-Binding Unit, and Binding Process]

Every time a sheet is delivered from the conveyance rollers 44, the delivery rollers 48 and the gathering roller 56 rotate, conveying the sheet to the reference surface 57 to lay the sheet onto the uppermost sheet laid in the sheet tray 54. Further, as the sheet is laid so, alignment plates 58 are made to abut on both sides of the sheet, aligning the sheet with the other sheets that part of the sheet tray 54, which is middle in the widthwise direction of the sheet tray 54. This sheet aligning is repeated until sheets are piled in the sheet tray 54 to a prescribed number. When sheets are piled to the prescribed number, a side-binding unit 62 is moved on a table 63 in the widthwise direction of the sheets to the desired binding position. The side-binding unit 62 is so moved, as the motion pin 62*b* of the side-binding unit 62 slides in a groove cut in the table 63 and extending in the widthwise direction of the sheets.

The side-binding process, i.e., the process the side-binding unit 62 adapted for the first process of the present invention performs, is known in the art, and is not explained herein. When the side-binding unit 62 stops at the designated position, a side-binding motor 62M is driven, moving a driver (not shown) and driving a stable into the sheet bundle. The anvil bends the staple thus driven, performing side binding on the sheet bundle. The side binding is performed also at several parts of the sides and ends of the sheet bundle.

[Delivering of the Side-Bound Sheets]

A reference-surface moving belt 64 is wrapped around a right pulley 65 and a left pulley 66 arranged below the sheet tray 54. As the reference-surface moving belt 64 is driven counterclockwise, the reference surface 57, as a moving member, of the sheet tray 54 coupled to the belt 64 moves to the left, pushing the sheet bundle with its bound end facing the first accumulating tray 24. As the sheet bundle is so pushed, the sheet bundle bound at the delivery rollers 48 (i.e., upper and lower delivery rollers 48*b* and 48*b*) located at the delivering port of the sheet tray 54 is pressed at both the obverse and reverse sides. As the delivery rollers 48 are rotated clockwise, the sheet bundle is delivered from the first accumulating tray 24.

[Up-Down Motion of the First Accumulating Tray]

The first accumulating tray 24 configured to receive a sheet bundle will be explained. As shown in FIG. 3, the first accumulating tray 24 is inclined at almost the same angle as the sheet tray 54. The first accumulating tray 24 receives the sheet bundle delivered from the sheet tray 54 and also the sheets delivered, one by one, from the conveyance path 42 by the conveyance rollers 44 and delivery rollers 48.

On the bottom of the first accumulating tray 24, a lift motor 24M is located to move the first accumulating tray 24 up and down. The drive force of the motor 24M is transmitted to a pinion 109. The pinion 109 meshes with two lift lacks 107 that are secured to the two lateral parts of the vertical wall 28 of the frame 20. The first accumulating tray 24 can move up and down on the rails (not shown) that are laid on the vertical wall 28 of the first accumulating tray 24.

The position of the first accumulating tray 24 or the position of the sheet laid in the first accumulating tray 24 are detected by a sheet-surface sensor 24S that is provided on the vertical wall 28. If the sheet-surface sensor 24S detects the surface of the sheet, the lift motor 24M is driven, rotating the pinion 109 and lowering the first accumulating tray 24. FIG. 3 shows a state in which the sheet-surface sensor 24S detects the top sheet on the the first accumulating tray 24. At the lower position, the first accumulating tray 24 receives a sheet bundle. Thus, the delivering port of the sheet tray 54 lies above the upper surface of the first accumulating tray 24.

Figure 4:
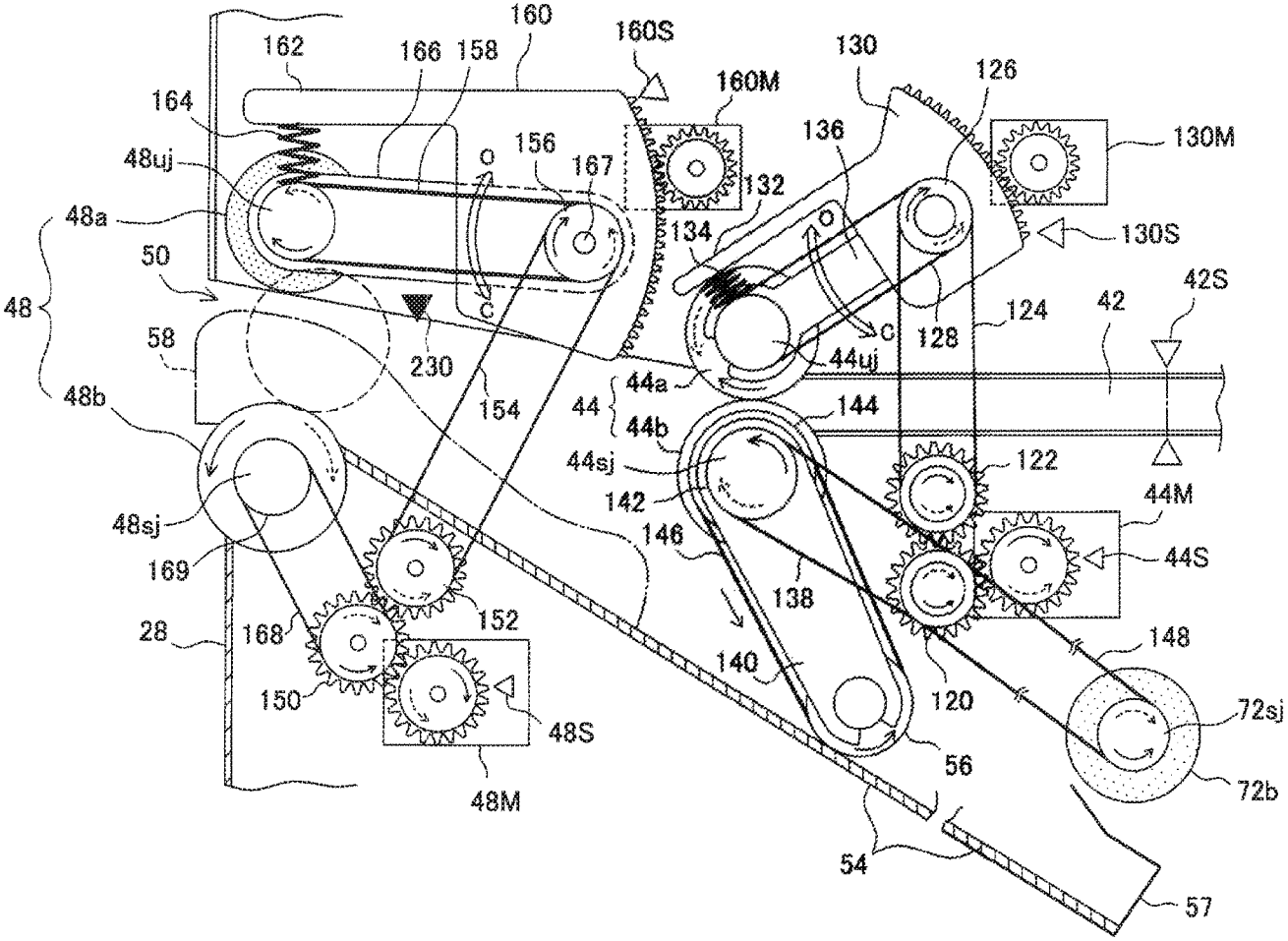
FIG. 4 is a diagram explaining how the conveyance rollers, branching rollers and delivery rollers are driven in the sheet processing apparatus.

How the conveyance rollers 44 and the delivery rollers 48 are rotated, and how the conveyance rollers 44 and the delivery rollers 48 respectively are moved toward and away from each other will be described with reference to FIG. 4.

[Driving of the Upper Conveyance roller]

The upper conveyance roller 44*a* and the lower conveyance roller 44*b* are driven by a conveyance roller motor 44M. The conveyance roller motor 44M is a hybrid-type stepping motor. A speed detection sensor 44S is provided to detect the rotation speed of the shaft of the motor 44M. The rotation of the motor shaft is transmitted via transmission gears 120 122 and a transmission belt 124 to an arm gear 126. The rotation of the arm gear 126 is transmitted by a transmission belt 128 to the upper roller shaft 44*ui* of an upper conveyance roller 44*a* supported by a conveyance roller supporting arm 136.

[Motion of the Upper Conveyance roller]

The upper conveyance roller 44*a* can rotate around the shaft of the arm gear 126, and can contact and leave the lower conveyance roller 44*b* fixed in place. The upper conveyance roller 44*a* can contact and leave the roller 44*b*, thanks to a conveyance roller moving arm 130. The arm 130 has a fan-shaped gear flaring backwards and fixed to the shaft of the arm gear 126 and a spring 134 biasing the upper conveyance roller 44*a* and attached to the moving arm tip at the end. That is, if an arm motor 130M for moving the conveyance rollers in mesh with the fan-shaped gear is driven in one direction, the arm 130 will move in the direction of arrow O, releasing the lower conveyance roller 44*b*. If the arm motor 130M is driven in the other direction, the arm 130 will move in the direction of arrow C to push the upper conveyance roller 44*a* onto the lower conveyance roller 44*b*. The arm motor 130M is a stepping motor, too. The position of the conveyance roller moving arm 130 is detected by a conveyance roller moving arm sensor 130S.

[Rotation of the Lower Conveyance Roller]

The lower conveyance roller 44*b* is rotated by transmitting the drive force of the conveyance roller motor 44M via the transmission gears 120 and a transmission belt 138 to a gear 142 mounted on a lower conveyance shaft 44*sj*.

As the gear 142 is driven, a gear 144 that has a one-way clutch gear and a belt 146 that has a projection and functions as transmission belt rotate the gathering roller 56. The gathering roller 56, which is driven via the gear 144, rotates in only one direction indicated by the solid-line arrow shown in FIG. 4 even if the gear 142 rotates in the forward direction or the reverse direction, as described above. That is, the gathering roller 56 rotates to convey the sheet only toward the reference surface 57 of the sheet tray 54.

At the front end of the belt 146 having a projection, the gathering roller 56 rotates. The gathering roller 56 may be dispensed with, and a circular gathering belt may be rotated instead.

The drive force of the conveyance roller motor 44M is transmitted via the transmission gear 120 and a transmission belt 148, also to a lower branch roller shaft 72*sj* of the lower branch roller 72*b* of the branch roller 72 that conveys sheets in the branch path 70.

In the apparatus B configured as described above, as the conveyance roller motor 44M is driven in the forward direction and the reverse direction, the conveyance rollers 44 and the branch rollers 72 rotate in one direction indicated by the solid-line arrow and the other direction (i.e., switch back direction) indicated by the broken-line arrow, and the gathering roller rotates toward the reference surface 57 as indicated by the solid-line arrow. The conveyance roller motor 44M can be set to convey sheets at a prescribed speed toward the sheet tray 54 or to switch back sheets toward the branch path 70.

[Rotation of the Upper Delivery Roller]

The delivery rollers 48, i.e., upper delivery roller 48*a* and lower delivery roller 48*b*, are driven by a delivery roller motor 48M. The delivery roller motor 48M is a hybrid-type stepping motor, too. A speed detection sensor 48S is provided to detect the rotation speed of the shaft of the motor 48M. The rotation of the motor shaft is transmitted via transmission gears 150 and 152 and a transmission belt 154 to an arm gear 156. The rotation of the arm gear 156 is transmitted by a transmission belt 158 to the upper roller shaft 48*uj* of the upper delivery roller 48*a* supported by a delivery roller supporting arm 166.

[Motion of the Upper Delivery Roller]

The upper delivery roller 48*a* can rotate around the shaft of the arm gear 156, and can contact and leave the lower delivery roller 48*b* fixed in place. The upper delivery roller 48*a* can contact and leave the lower delivery roller 48*b*, by virtue of a delivery roller moving arm 160. The arm 160 has a fan-shaped gear flaring backwards and fixed to the shaft of the arm gear 156 and a spring 164 biasing the upper delivery roller 48*a* and attached to the moving arm tip at the end. If an arm motor 160M in mesh with the fan-shaped gear is driven in one direction, the arm 160 will move in the direction of arrow O, releasing the lower conveyance roller 44*b*. If the arm motor 160M is driven in the other direction, the arm 160 will move in the direction of arrow C to push the upper delivery roller 48*a* onto the lower delivery roller 48*b*.

The arm motor 160M for moving the delivery roller is a stepping motor, too. The position of the delivery roller moving arm 160 is detected by a conveyance roller moving arm sensor 160S. The lower delivery roller 48*b* is rotated by transmitting the drive force of the delivery roller motor 48M via the transmission gear 150 and a transmission belt 168 to a gear 169 amounted on a lower delivery roller shaft 48*sj*.

[Setting of the Speed of the Delivery Roller Motor]

In the configuration described above, as the delivery roller motor 48M rotates in the forward and reverse directions, the delivery rollers 48 rotate in one direction indicated by the solid-line arrow or in the other direction indicated by the broken-line arrow (thereby switching back the following sheet on the sheet tray 54 toward the reference surface 57 after the following sheet has been released from the conveyance rollers 44). The delivery roller motor 48M can be driven at a preset speed to drive the conveyance rollers 44 at a prescribed speed.

[Wait Conveyance and Second Tray Conveyance]

Referring back to FIG. 3, it will be described how sheets are switched back and kept waiting in the branch path 70 to achieve the above-described side binding. To perform the side binding in the side-binding unit 62 located near the sheet tray 54, sheets must be prevented from being conveyed to the side-binding unit 62 if the preceding sheets have not been side-bound because they, each having an image formed in the image forming apparatus A, are conveyed at high speed and spaced apart by a short distance. Therefore, the first to third following sheets conveyed to the conveyance path 42 via the feed-in path 32 are switched back in the conveyance path 42 and then kept waiting in the branch path 70. The first following sheet is then overlapped on the second or third following sheet. The overlapping sheets are conveyed from the branch path 70, thereby spacing the sheet bundles sufficiently. (This technique is disclosed in, for example, FIG. 10 of Japanese Patent No. 5,248,785.)

Hereinafter, the process of switching back a sheet from the conveyance path 42 to the branch path 70, keeping one or more sheets waiting in the branch path 70 and convey the sheet or sheets from the branch path 70 together with the next sheet shall be referred to as "wait conveyance". Most sheets undergoing the wait conveyance to be side-bound are relatively short, such as A4-size, B5-size and letter-size sheets. Hence, these sheets can be switched back without extending greatly into the downstream area of the sheet tray 54. Nor will they be bent while they are conveyed. Even if they are bent a little, they can be straightened up as they are aligned by the aligning plates 58 since the distance to the sheet tray 54 is comparatively short.

When the completion of the side binding means not only the completion of sheet delivery from the sheet tray 54 to the first accumulating tray 24, but also the initial setting of the aligning plates 58 provided on the sheet tray 54 and the returning of the reference-surface moving belt 64 to its initial position or the setting of each mechanism at the initial position to receive the next sheet.

It will be explained how the sheets saddle-bound in the saddle binder 82 are conveyed to the stacker 84 in order to fold them double by the folding roller 92 and folding blade 94 into a folded sheet bundle. The sheets conveyed to the conveyance path 42 via the feed-in path 32 are first switched back in the conveyance path 42 and then conveyed from the branch path 70 to the stacker 84. The step of conveying the switched-back sheets from the branch path 70 to the stacker 84 shall be called "second tray conveyance" hereinafter.

[Switch-Back Conveyance]

In this embodiment, the "wait conveyance" of a sheet is achieved by first detecting the rear end of the sheet by the sheet sensor 42S provided at the branch position between the conveyance path 42 and the branch path 70. Then, the sheet is switched back to the branch path 70 and nipped by the branch rollers 72 positioned at the branch path 70, and the branch rollers 72 are stopped rotating. To perform the "second tray conveyance" for collecting the sheets in the stacker 84 positioned downstream the branch path 70, the sheets switched back by the conveyance rollers 44 are conveyed to the branch rollers 72 provided at the branch path 70 and then continuously conveyed to the stacker 84.

The delivery rollers 48 can rotate in both the forward direction and the reverse direction. When the rear end of a following sheet (i.e., sheet waiting in the branch path 70, sheet conveyed from the feed-in path or a sheet overlapping another) comes out of the conveyance rollers 44, it is nipped by the delivery rollers 48. When the delivery rollers 48 are rotated in the reverse direction, the following sheet is switched back and stored into the sheet tray 54.

Here, it will be described how the position the front end of any following sheet switched back at the sheet tray 54 takes with respect to the reference surface 57. In the sheet bundle of following sheets switched back on the sheet tray 54, the front end of the first following sheet should be nearest to the reference surface 57, and the front ends of the second and third following sheets should be far from the reference surface 57. This is because when the sheets are being conveyed by the gathering roller 56, if the uppermost following sheet reaches the reference surface 57 earlier, any lower following sheet will slip with the other lower following sheet and will no longer be conveyed. Consequently, the sheets will be bound with their front ends not aligned, forming an untidy sheet bundle. Thus, the above-mentioned order in which the sheets are conveyed is important to prevent a sheet-alignment failure.

[Delivery of the Sheet Bundle]

As explained above, the upper delivery roller 48*a* can be moved up and down. When it moves down to the position (indicated by the broken line in FIG. 4), it pushes the lower delivery roller 48*b*. When it moves up, it assumes the position (indicated by solid line in FIG. 4). After the sheets have been bundled at the sheet tray 54, the reference-surface moving belt 64 moves the reference surface 57 up toward the outlet port 50. Then, the upper delivery roller 48*a* is lowered and cooperates with the lower delivery roller 48*b*, nipping the sheet bundle and conveying the sheet bundle to the outlet port 50. The sheet bundle is then delivered onto the first accumulating tray 24.

[Sheet Processing Unit]

The sheet bundle delivered by the delivery rollers 48 is processed in the sheet processing unit provided at the sheet tray. The sheet processing includes two processes. The first process is a side binding performed in the side-binding unit 62. The second process is a so-called jog process of first arranging the sheets at different positions on the sheet tray 54 by using the aligning plates 58, then delivering the sheets to the first accumulating tray 24, and finally sorting the sheets without binding them. The sheet processing further includes a sheet bonding process of bonding the sheets with glue and punching process of punching the sheets.

[Acquisition of Sheet-Bundle Thickness Data BPt]

The sheet tray 54 has, on the upper frame thereof, a bundle thickness sensor 230 configured to acquire data representing the thickness of the sheet bundle (sheet-bundle thickness data BPt) that is laid on the sheet tray 54. The sensor 230 is a reflection-type sensor. The reflection-type sensor may be replaced by a sensor having a lever that may enter the space between the two sensor elements.

The sensor 42S may be used to count the sheets delivered onto the sheet tray 54, and the count data acquired may be used as thickness data (i.e., sheet-bundle thickness data Bpt). The thickness data may be acquired from the image forming apparatus A. The thickness data (i.e., sheet-bundle thickness data Bpt) is used, setting the space between the sheets switched back and waiting, or the space between the sheets waiting in the branch path 70. Therefore, the thickness data (i.e., sheet-bundle thickness data Bpt) is acquired before the sheets are bundled at the sheet tray 54, more precisely before the following sheets are switched back and kept waiting in the branch path 70.

[Simultaneous Bundle Delivering]

With reference to FIG. 5A to FIG. 16 it will be explained how the sheet bundle on the sheet tray 54 and the sheets and some following sheets waiting in the branch path 70 are simultaneously delivered by the delivery rollers 48 and are switched back to the first accumulating tray 24 and the sheet tray 54, respectively. Referring to FIG. 5A to FIG. 9B, it will be described how a relatively thin sheet bundle (i.e., bundle composed of relatively small number of sheets) and the following sheets are delivered at the same time. Referring to FIG. 10 to FIG. 13B and FIG. 16, it will be described how a relatively thick sheet bundle (i.e., bundle composed of relatively large number of sheets) and the following sheets are delivered at the same time. Referring to FIG. 14 and FIG. 15, it will be described how the sheets are positioned, where the following sheets are positioned, how much they are spaced apart, and where the following sheets are switched back on the sheet tray 54.

[Simultaneous Delivery of a Thin Bundle (Small Number of Sheets) and Following Sheets]

FIG. 5A to FIG. 9B are diagrams explaining how a relatively thin bundle (composed of three sheets) is held on the sheet tray and the following sheets (three sheets) are kept waiting. As seen from FIG. FIG. 5A, the conveyance rollers 44 may convey the first sheet P1 from the conveyance path 42 onto the sheet tray 54. If the sheet sensor 42S detects the rear end of the sheet P1 and the counter (not shown) counts the first sheet P1, the sheet P1 is conveyed from the conveyance rollers 44 to the sheet tray 54. At the same time the sheet P1 is so conveyed, the upper delivery roller 48*a* is moved from the position (indicated by broken lines) to the position (indicated by solid lines). Thereafter, the upper delivery roller 48*a* is rotated counterclockwise, switching back the first sheet P1 on the sheet tray 54, and conveying the first sheet P1 toward the reference surface 57.

Figure 5A:
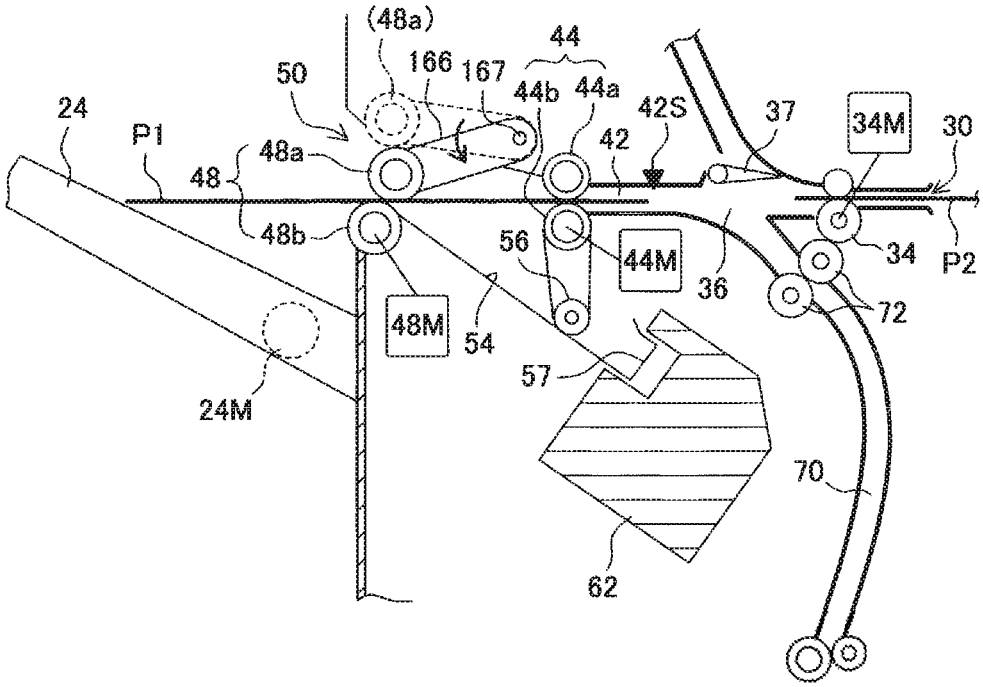
FIGS. 5A and 5B are diagrams explaining how a relatively thin sheet bundle (i.e., bundle consisting of three sheets) is mounted on the sheet tray and how the following sheets (i.e., three sheets) remain in the standby tray, FIG. 5A showing how the conveyance rollers convey a sheet from the conveyance path, and FIG. 5B showing how the sheet delivered is switched back onto the sheet tray.
Figure 5B:
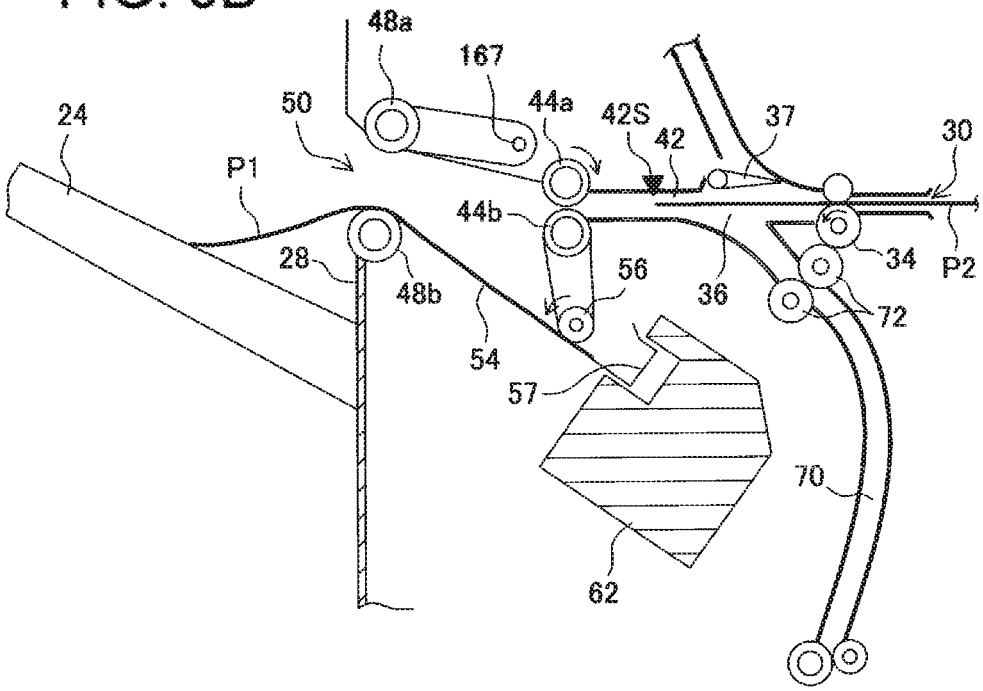
Figure 16:
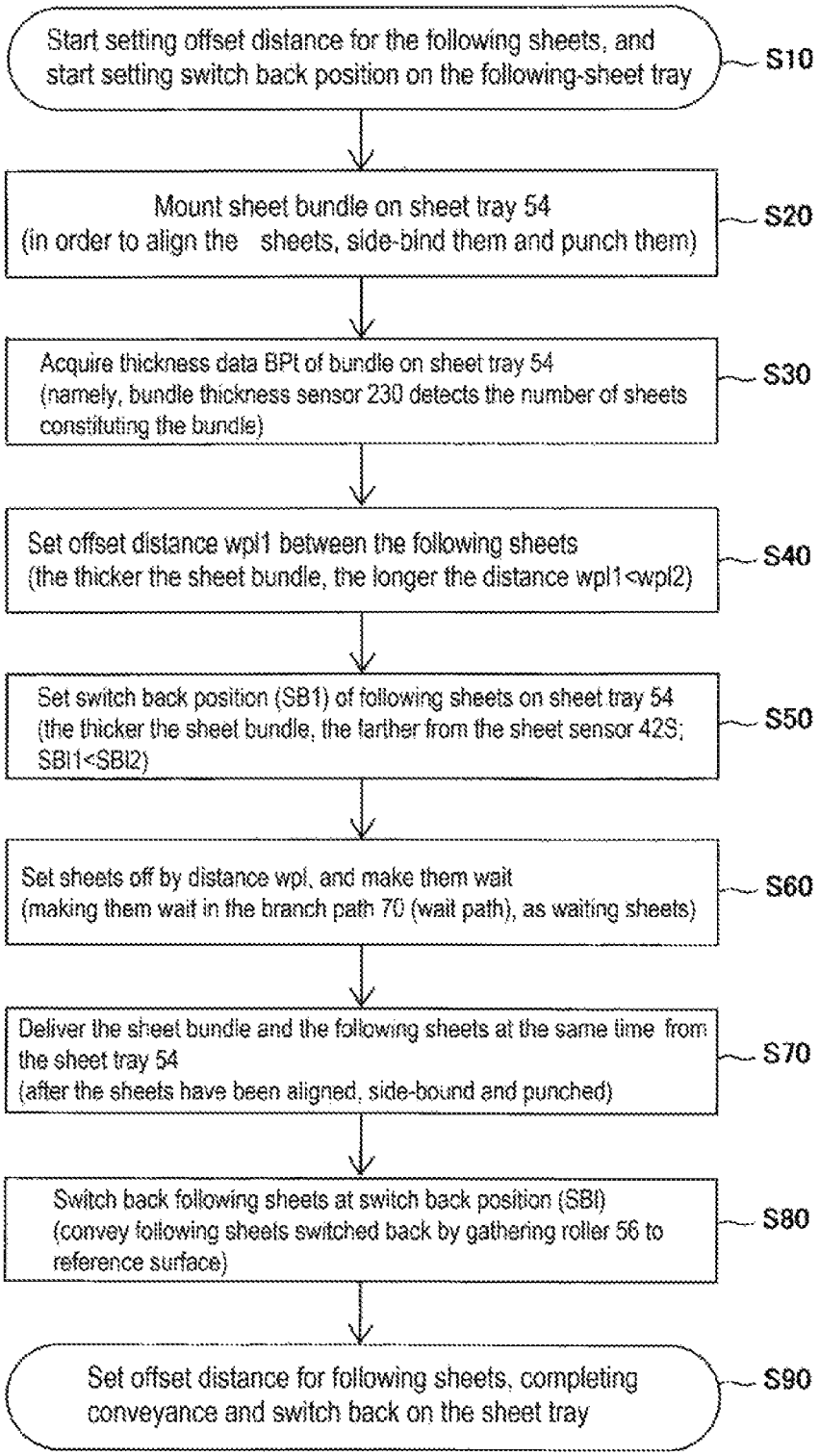
FIG. 16 is a flowchart showing how the offset distance between the following sheets is set and how the sheet switch back position of the following sheet is set at the sheet tray.

Next, as shown in FIG. 5B, the delivery rollers 48 are rotated counterclockwise, switching back the first sheet P1. The first sheet P1 switched back is conveyed toward the reference surface 57 by the gathering roller 56 and the belt 146 having a projection and is mounted on the sheet tray 54. Then, the aligning plates 58 are moved, aligning the sheet at the center of the aligning plates 58. When the second sheet is conveyed onto the sheet tray 54 and its front end is detected by the sheet sensor 42S, the delivery rollers 48*a* are moved from the position indicated by broken lines to the position indicated by solid lines. Then, the second sheet is conveyed in the same way as shown in FIG. 5A, forming a sheet bundle BP1 composed of three sheets (P1, P2 and P3). The process goes to the step shown in FIGS. 6A and 6B. The step of "Start setting the offset distance for the following sheets, and start setting the switch back position on the following-sheet tray" (S10), shown in FIG. 16, is performed before the operation of FIGS. 5A and 5B.

Figure 6A:
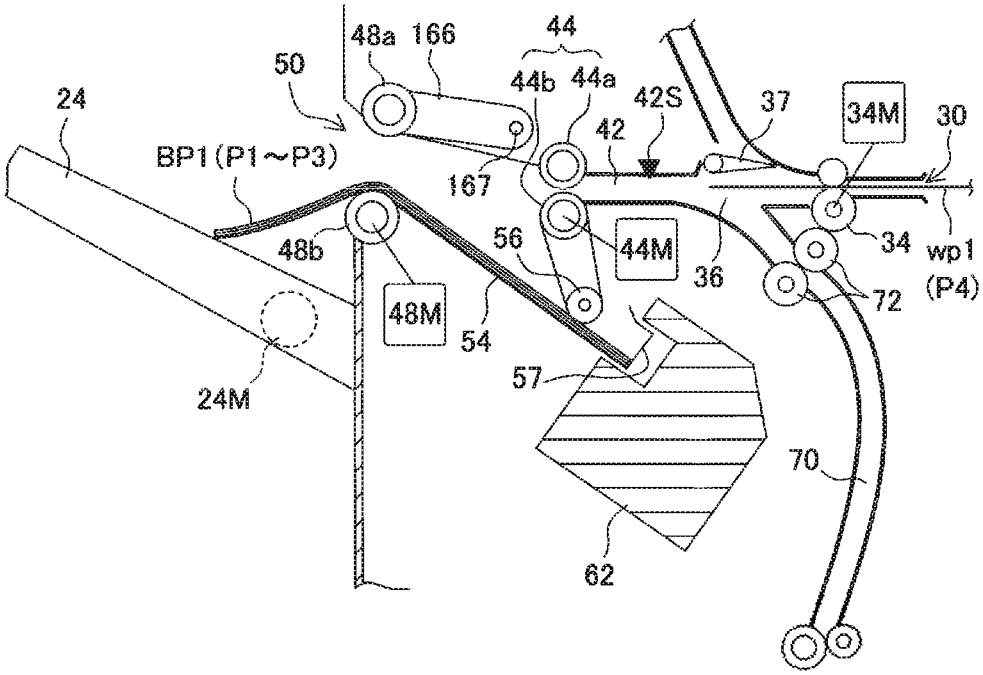
FIGS. 6A and 6B are diagrams explaining the process following the process of FIGS. 5A and 5B, FIG. 6A showing the first three sheets mounted on the sheet tray, and FIG. 6B showing the first following sheet wp1 conveyed to the sheet tray.
Figure 6B:
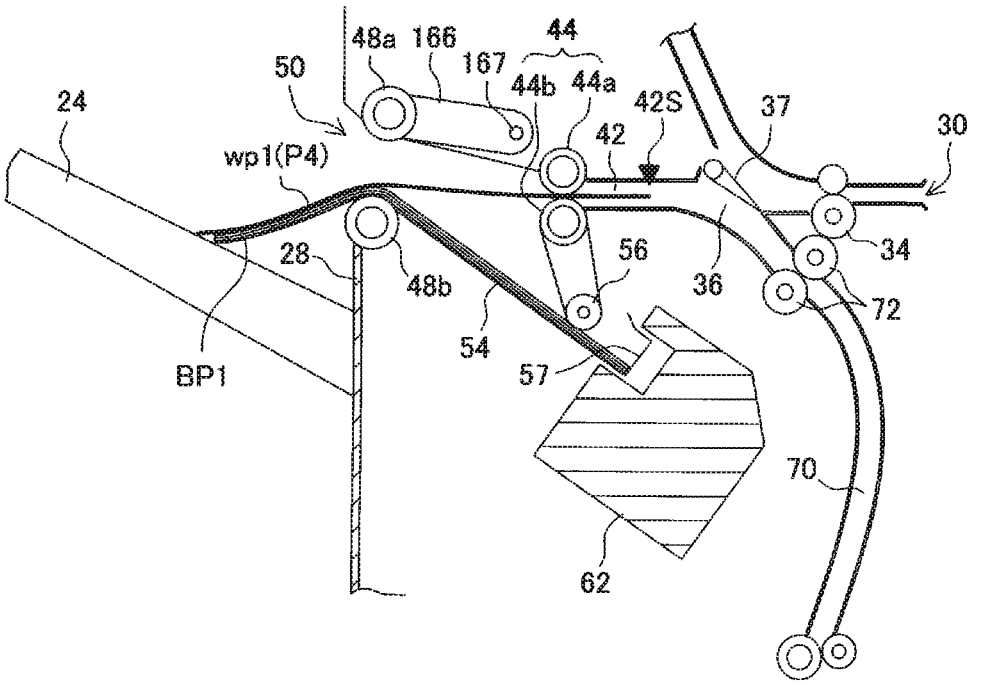

FIGS. 6A and 6B are diagrams explaining the process following the process of FIGS. 5A and 5B. FIG. 6A shows how the sheet bundle BP1 (composed of first three sheets P1, P2 and P3) is mounted on the sheet tray 54. FIG. 16 describes this state as "Mount the sheet bundle on the sheet tray 54" (S20).

In the step of FIGS. 6A and 6B, the side-binding unit 62 performs the side binding. Prior to this process, the bundle thickness sensor 230 described with reference to FIG. 4 detects the thickness of the sheet bundle, acquiring the bundle-thickness data BPt showing the bundle is relatively thin (S30). The conveyance of the first following sheet (wp1), i.e., fourth sheet, starts as shown in FIG. 6A. The sheets forming the bundle BP1 on the sheet tray 54 are completely aligned, and the side-binding unit 62 is moved to perform the side binding.

Upon receiving the bundle-thickness data BPt, a unit (i.e., sheet conveyance control unit 210 to be described later) sets an offset distance wp11 for any two following sheets. In FIG. 16, this step is described as "Set the offset distance wp11 between the following sheets (the thicker the sheet bundle, the longer the distance)" (S40). Further, the step of setting the position on the sheet tray 54, where the sheets are switched back, is described as "Set a switch back position (SB1) on the sheet tray 54 (the thicker the sheet bundle, the farther from the sheet sensor 42S" (S50).

As shown in FIG. 6B, the fourth sheet P4 (i.e., first waiting sheet wp1) is conveyed by the conveyance rollers 44 beyond the delivery rollers 48. When the sheet sensor 42S detects the rear end of the sheet wp1, the sheet wp1 is switched back. At this point, the switching gate 37 located between the conveyance path 42 and the branch path 70 assumes the position indicated by solid lines, and guides the sheet wp1 to the branch path 70.

Figure 7A:
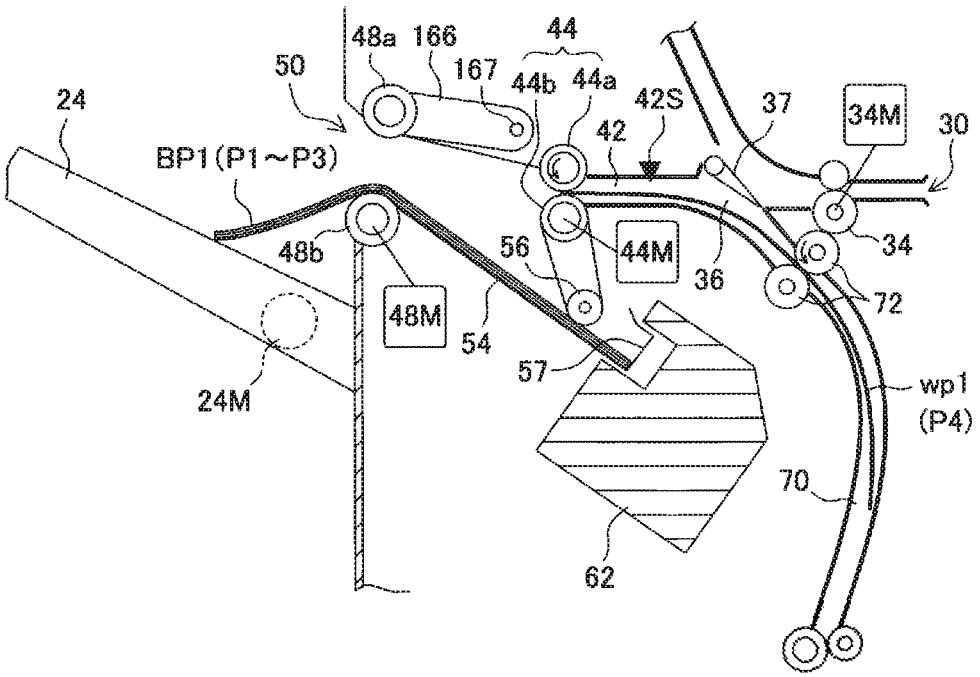
FIGS. 7A and 7B are diagrams explaining the process following the process of FIGS. 6A and 6B, FIG. 7A showing how the first following sheet wp1 is switched back by the conveyance rollers and then waits in the branch path (i.e., wait path), and FIG. 7B showing how the first following sheet wp1 waits in the branch path and how the second following sheet wp2 is conveyed.
Figure 7B:
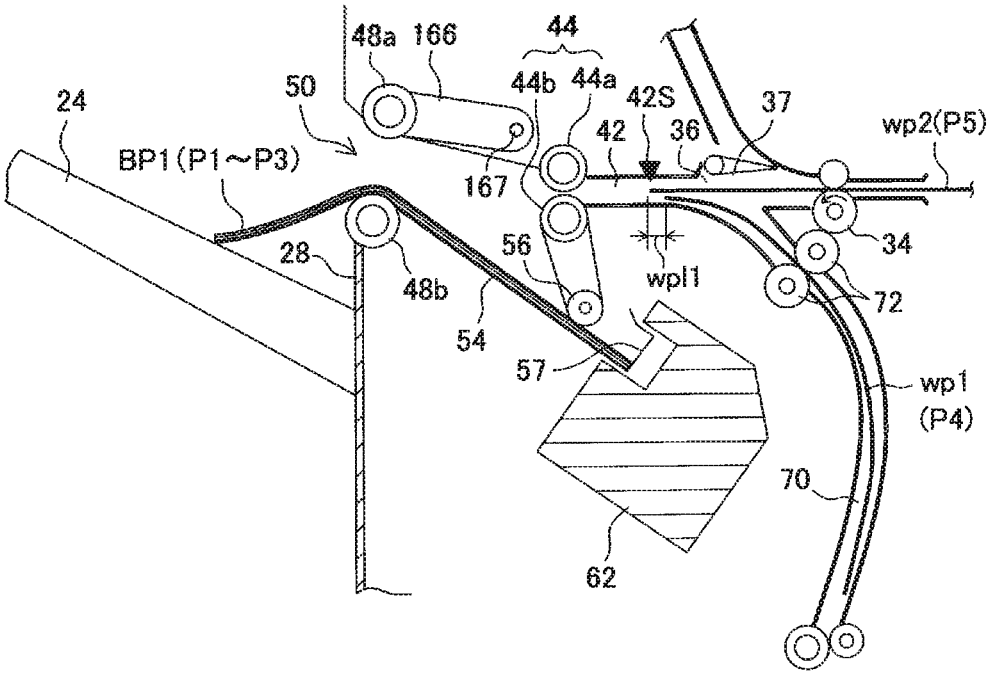

FIGS. 7A and 7B are diagrams explaining the process following the process of FIGS. 6A and 6B. As shown in FIG. 7A, the side-binding unit 62 starts side-binding the sheet bundle BP1 mounted on the sheet tray 54. During the side-binding process, the fourth sheet wp1 cannot be conveyed onto the sheet tray 54. Therefore, the conveyance rollers 44 continues the switch-back conveyance, and the branch rollers 72 located at the branch path 70 and rotating in synchronism with the conveyance rollers 44 convey the sheet bundle BP1 downstream the branch path 70. When the branch rollers 72 nip the following sheet P3, the switching gate 37 is moved up, opening the conveyance path 42.

While the branch rollers 72 are conveying the sheet P3, the sheet sensor 42S may detect the rear end of the fourth sheet wp1 (as viewed in the conveyance direction). If the rear end of the fourth sheet wp1 is detected, a counter (not shown) detects the distance the rear end of the fourth sheet has moved. When the distance is found wp11 from the sheet sensor 42S, the branch rollers 72 are stopped rotating, and the branch rollers 72 wait for the fifth sheet wp2.

As shown in FIG. 7B, a binding process is performed on the sheet bundle BP1 on the sheet tray. Meanwhile, the fifth sheet wp2 is conveyed by the feed-in rollers 34 toward the conveyance rollers 44. If the sheet sensor 42S detects the rear end of the fifth sheet wp2, the sheet wp1 (i.e., fourth sheet P4 following) and the fifth sheet wp2 are conveyed toward the conveyance rollers 44, with offset distance wp11 between them.

The setting of the offset distance is described in FIG. 16 as "Set the sheets off by distance wp1, and make them wait (that is, making them wait in the branch path 70 (wait path) as waiting sheets)" (S60). If the sheet bundle BP1 is thin, the offset distance is set to wp11. If two or more sheets follow, the offset distance has the value of wp11, too. It should be noted that the waiting sheets are conveyed at the speed of 650 mm/sec. In this step of the process, the sheets are completely bound together, forming a bundle BP1.

While the following fourth sheet wp1 (P4) waiting at the branch path 70 and the fifth sheet wp2 (P5) conveyed from the feed-in rollers are spaced by distance wp11. This distance wp11 is an important factor that enhances the alignment of the sheets switched back onto the sheet tray 54 and bent in the form of inverted V.

Figure 8A:
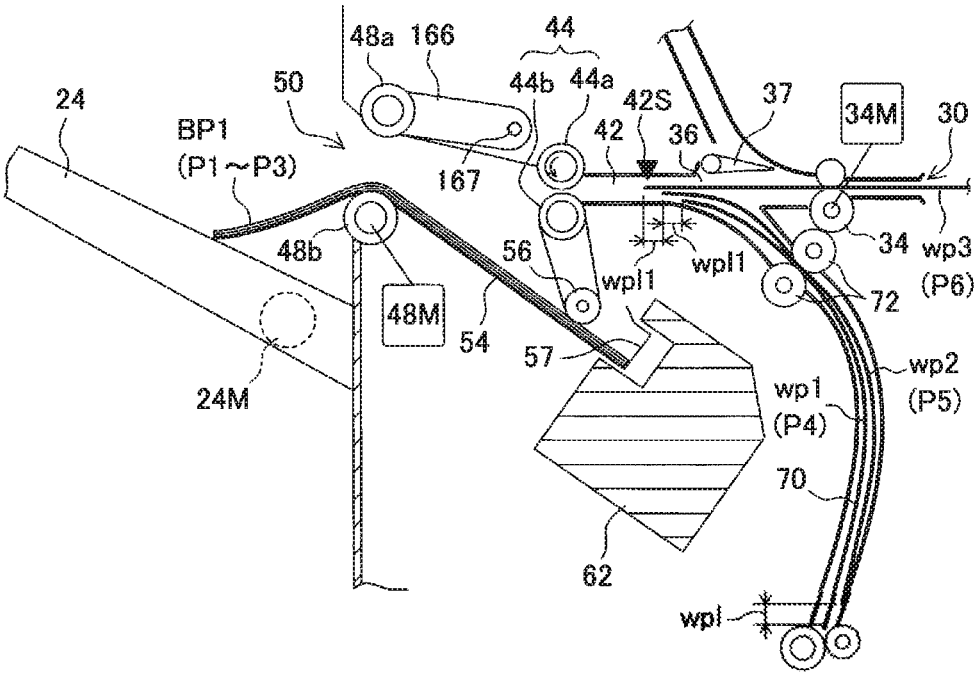
FIGS. 8A and 8B are diagrams explaining the process following the process of FIGS. 7A and 7B, FIG. 8A showing how the two following sheets wp1 and wp2 wait in the branch path and how the third following sheet wp3 is conveyed, and FIG. 8B showing how the sheet bundle BP1 is delivered from the sheet tray, how the three following sheets wp1 to wp3 are nipped together with the sheet bundle BP1 and how the bundle BP1 and the following sheets wp1 to wp3 are delivered at the same time.
Figure 8B:
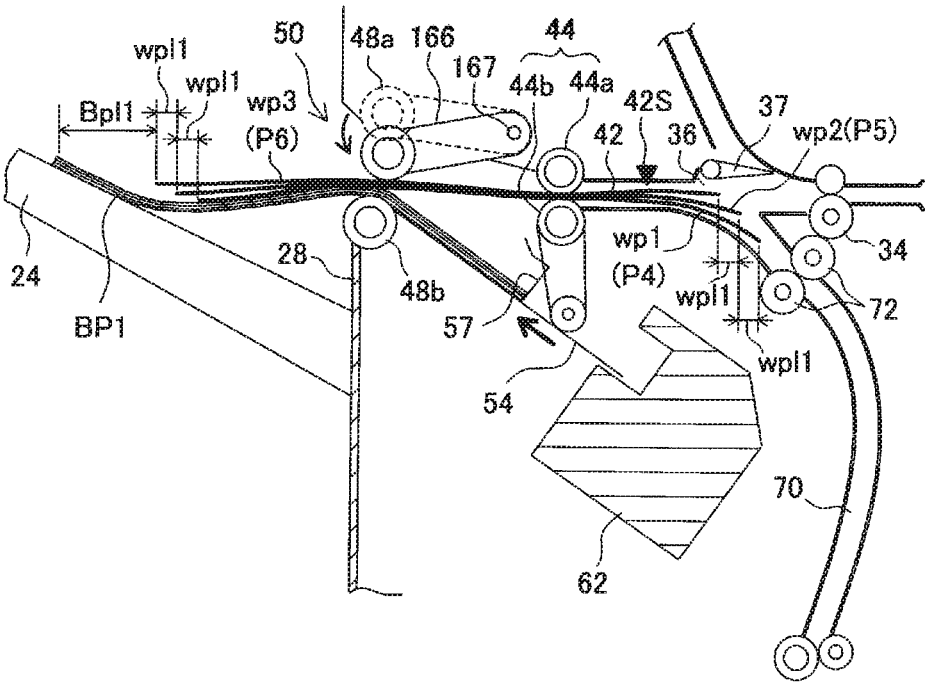

FIGS. 8A and 8B explain the process following the process of FIGS. 7A and 7B. As shown in FIG. 8A, two following sheets wp1 and wp2 (P4 and P5) wait in the branch path, and a following third sheet wp3 (P6) is conveyed. As shown in FIG. 7B, the following fourth and fifth sheets wp1 and wp2 (P4, P5) waiting in the branch path 70 are conveyed to the conveyance rollers 44, with the front end of the following sheet wp2 at the head. The conveyance rollers 44 nip the fifth sheet P4 and the fifth sheet P5 at the same time and convey them to the conveyance rollers 44. If the sheet sensor 42S detects the rear end of the fifth sheet P4, the conveyance rollers 44 are rotated counterclockwise again.

At this point, the switching gate 37 assuming the branch position 36 closes the feed-in path 32, guiding the two following sheets wp1 and wp2 (P4 and P5), respectively, to the branch path 70. Eventually, the rear end of the following fifth sheet wp3 (P5) is detected by the sheet sensor 42S, and the sheet wp2 set off by distance wp11 is conveyed to the branch path 70. Then, the branch rollers 72 are stopped, and the following sixth sheet wp3 (P6) is fed to have its front end detected by the sheet sensor 42S. FIG. 8A illustrates this state. At this point, the following sheets wp1 to wp3 are set off by distance wp11.

FIG. 8B shows how the delivery rollers 48 nip and deliver the sheets wp1 to wp3 together with the sheet bundle BP1 while making the sheets wp1 to wp3 set off from one another by distance wp11 and the sheet wp1 set off from the front end of the sheet bundle BP1 by distance Bp11. That is, the sheet bundle BP1 is pushed on the reference surface 57 toward the outlet port of the sheet tray 54, and the upper delivery roller 48*a* is lowered, nipping the sheets wp1 to wp3. The sheets wp1 to wp3 are so nipped in order to set off the front end of the uppermost following sheet wp3 from the front end of the sheet bundle BP1 by distance Bp11. The sheet bundle BP1 set off by this distance Bp11 is delivered by the delivery rollers to the first accumulating tray 24.

Since the three following sheets wp1 to wp3 have the same length, the uppermost following sheet wp3, the intermediate following sheet wp2 and the lowermost following sheet wp1 are set off toward the accumulating tray 24 by distance wp11. In other words, the uppermost sheet wp3 is farthest from the reference surface 57, the lowermost sheet wp1 is nearest to the reference surface 57, and the sheet wp2 is at an intermediate distance from the reference surface 57 while they are being switched back on the sheet tray 54. This state is described In FIG. 16 as "Deliver the sheet bundle and the following sheets at the same time from the sheet tray 54 (after the sheets have been aligned, side-bound and punched)" (S70).

Figure 9A:
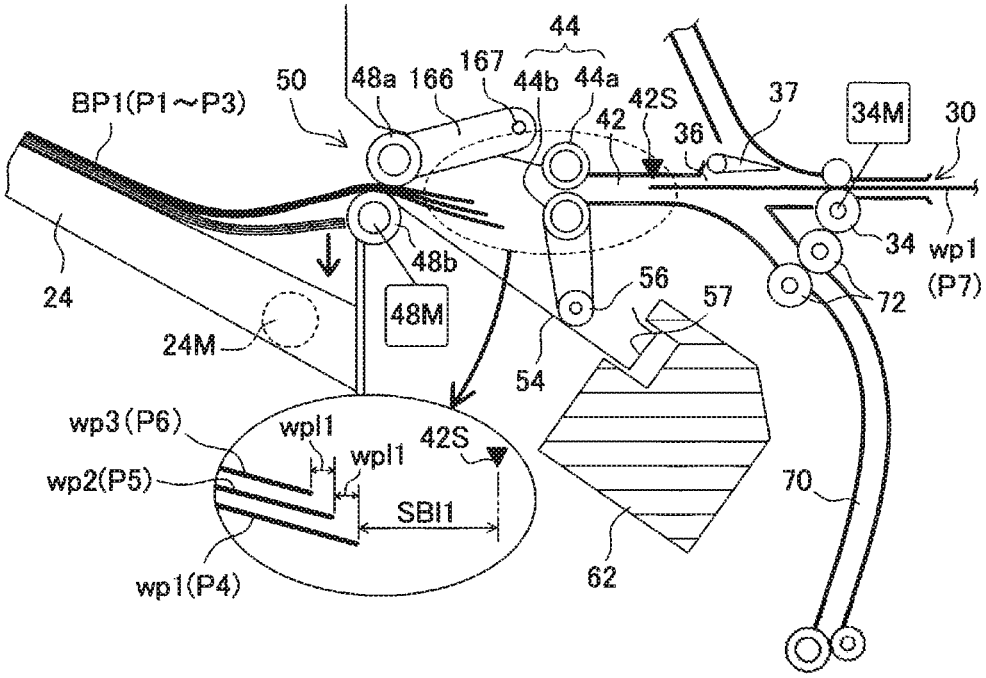
Figure 9B:
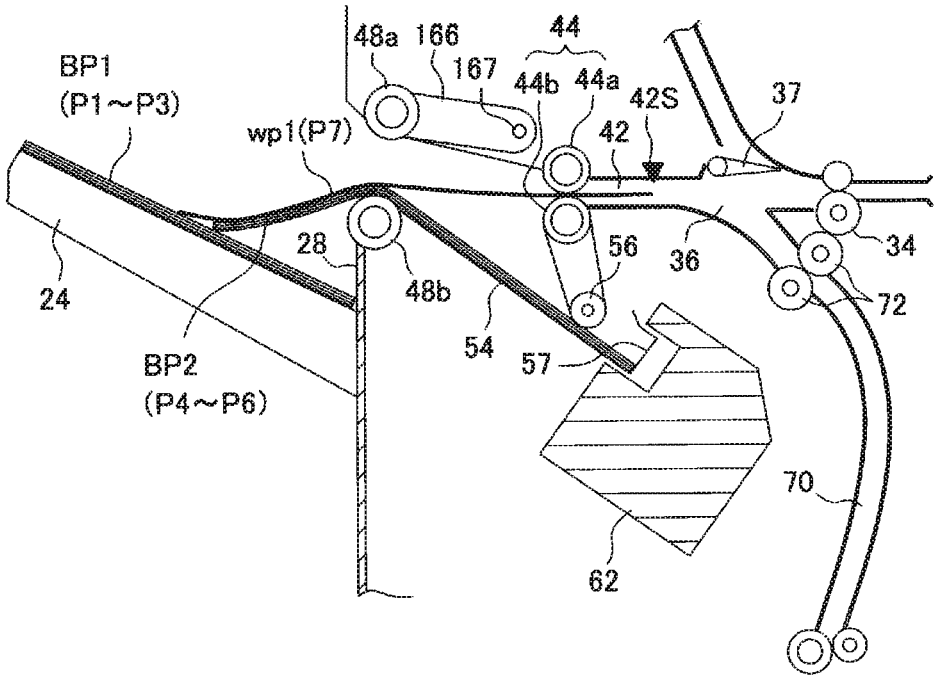

FIGS. 9A and 9B following the process of FIGS. 8A and 8B illustrate how the sheet bundle BP1 is delivered onto the first accumulating tray 24 and how the following sheets wp1 to wp3 are switched back on the sheet tray 54. As shown in FIG. 9A, the sheet bundle BP1 mounted on the sheet tray 54 and the following sheets wp1 to wp3 conveyed by the conveyance rollers 44 are nipped and delivered at the same time by the delivery rollers 48, the sheet bundle BP1 is held on the first accumulating tray 24, and the following sheets wp1 to wp3, overlapping one another and set off from one another by distance Bp11, are held on the sheet tray 54.

In this process, the rear ends of the following sheets wp1 to wp3 are set off by distance wp11 and are bent in the form of inverted V, as described above (see the enlarged part of FIG. 9A, encircled by an ellipse). Even if the delivery roller 48*a* rotates in this state around a support arm shaft 167 located upstream the delivery roller 48*a*, the delivery roller 48*a* rotates only a little because the sheet bundle BP1 delivered is composed of three sheets and relatively thin. Hence, the distance wp11 by which the following sheets wp1 to wp3 are set off changes only a little. Therefore, the following sheets wp1 to wp3 are left on the sheet tray 54 and are switched back toward the reference surface 57 as the delivery rollers 48 rotate in the direction reverse to the sheet-delivering direction.

The switch back position is set so that the sheet bundle BP1 may be delivered before the rear end of the following sheet wp1 (i.e., sheet nearest to the reference surface 57) reaches a position away from the sheet sensor 42S by distance SB11, and the following sheets wp1 to wp3 may then be switched back. The distance SB11 is not influenced so much by the delivering of the sheet bundle BP1, and the following sheets remains on the sheet tray 54. In FIG. 16, this state is described as "Switch back the following sheets at the switch back position (SB1) (convey the following sheets switched back by the gathering roller 56 to the reference surface)" (S80). As shown in FIG. 9B, the gathering roller 56 and the belt 146 having a projection make the front ends of the following sheets wp1 to wp3 sequentially abut and aligned on the reference surface 57.

FIG. 9B shows the following sheets wp1 to wp3 abutting on the reference surface 57. The second sheet bundle BP2 (composed of sheets P4 to P6) is mounted on the sheet tray 54. Before this bundle is so mounted, the upper delivery roller 48*a* is moved from the lower delivery roller 48*b* to the position indicated by solid lines, allowing the seventh sheet wp1 of the third bundle to move above the first accumulating tray 24. The state shown in FIG. 9B is substantially identical to the state shown in FIG. 6B. The operation is repeated until a prescribed number of sheet bundles are formed. Only the last sheet bundle is delivered onto the first accumulating tray 24, completing the operation. This state is described in FIG. 16 as "Set the offset distance for the following sheets, completing the conveyance and the switch back on the sheet tray 54" (S80).

[Delivering of a Bundle, along with a Relatively Thick Bundle (Large Number of Sheets)]

Figure 10A:
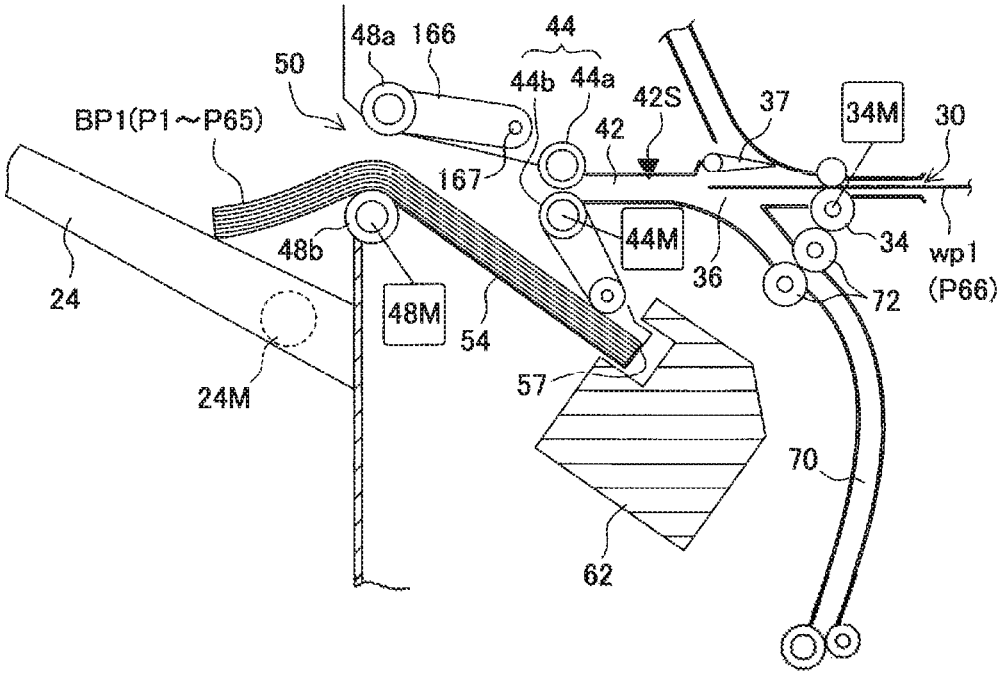
FIGS. 10A and 10B are diagrams explaining the process following the process of FIGS. 5A and 5B, i.e., mounting a relatively thick sheet bundle (i.e., 65 sheets) on the sheet tray and keeping the following sheets (i.e., three sheets) in wait, FIG. 10A showing how the first following sheet wp1 of the second bundle is conveyed in, and FIG. 10B showing how the rear end of the first following sheet wp1 of the second bundle is detected and how the first following sheet wp1 is then switched back.
Figure 10B:
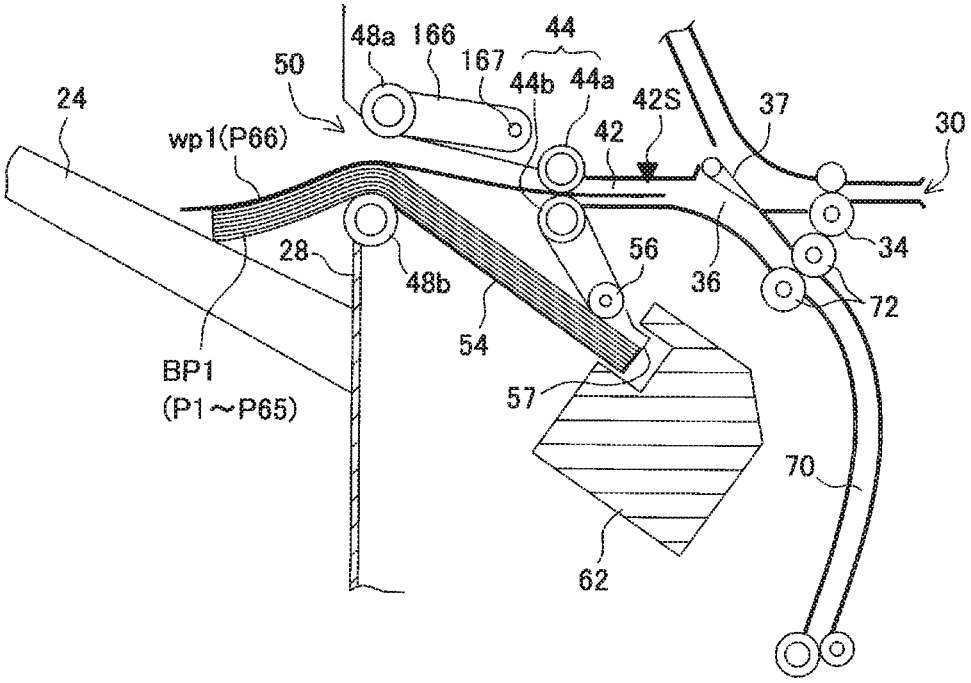

It will be explained how a sheet bundle is delivered together with a relatively thick sheet bundle (i.e., bundle composed of many sheets), with reference to FIG. 10A to FIG. 13B and FIG. 16. FIGS. 10A and 10B are diagrams explaining the process following the process of FIGS. 5A and 5B, i.e., mounting a relatively thick sheet bundle on the sheet tray and keeping the following sheets (i.e., three sheets) waiting. As has been explained with reference to FIGS. 5A and 5B, the sheet conveyed by the feed-in rollers 34 is further conveyed onto the sheet tray 54 by the conveyance rollers 44. The sheet is then switched back by the delivery rollers 48. Further, the sheet is conveyed by the gathering roller 56 and the belt 146 having a projection, abutting on the reference surface 57. Then, the sheets are mounted, in designated number, on the sheet tray 54. Prior to these operations, as in the case where a relatively thin sheet bundle is mounted, the step S10 of "setting the offset of the following sheets" and "setting the switch back position on the following-sheet tray" is started as shown in FIG. 16.

FIG. 10A shows 65 sheets P1 to P65 mounted on the sheet tray 54. That is, as specified in FIG. 16, "the sheet bundle has been mounted on the sheet tray 54" (S20). The side-binding unit 62 starts side-binding the sheet bundle. As explained with reference to FIG. 4, the bundle thickness sensor 230 described with reference to FIG. 4 detects the thickness of the sheet bundle, acquiring the bundle-thickness data BPt showing the bundle is relatively thin (S30). FIG. 10A also shows the conveyance of the following sheet wp1 (i.e., $66^{th}$ sheet) is started. The sheets of the bundle BP1 are completely aligned on the sheet tray 54, and the side-binding unit 62 moves to the binding position to side-bind the sheet bundle.

FIG. 10B shows how the sheet sensor 42S detects the rear end of the first following sheet wp1 of the second bundle BP2 and how the first following sheet wp1 is then switched back. At this point, the switching gate 37 configured to guide the sheet wp1 into the conveyance path 42 or the branch path 70 has been moved to the position indicated by solid lines and can guide the sheet wp1 into the branch path 70.

Figure 11A:
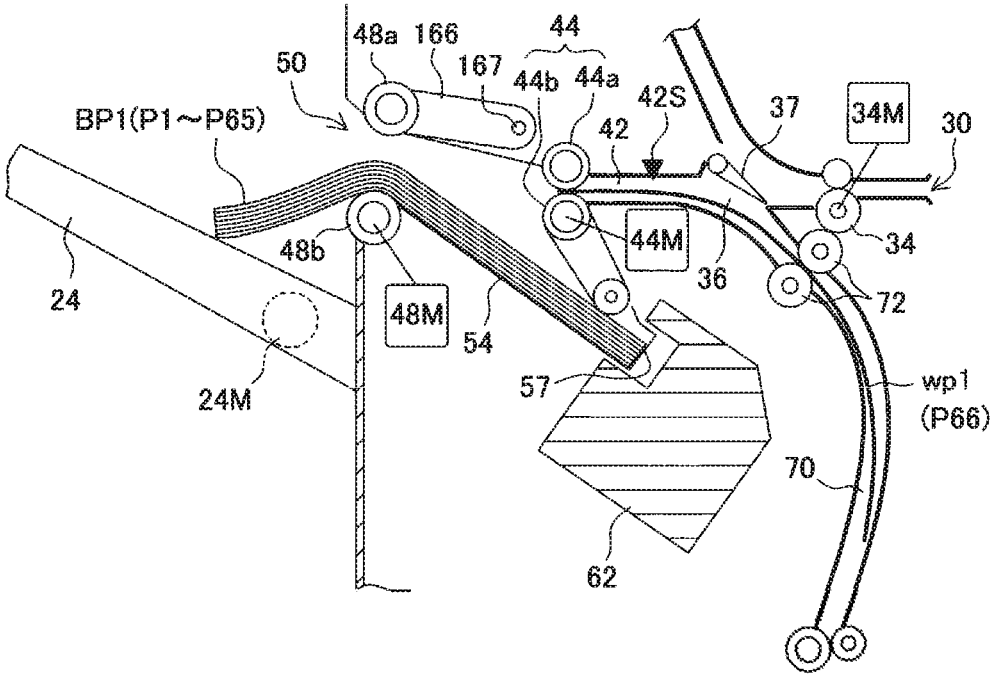
FIGS. 11A and 11B are diagrams explaining the process following the process of FIGS. 10A and 10B.
Figure 11B:
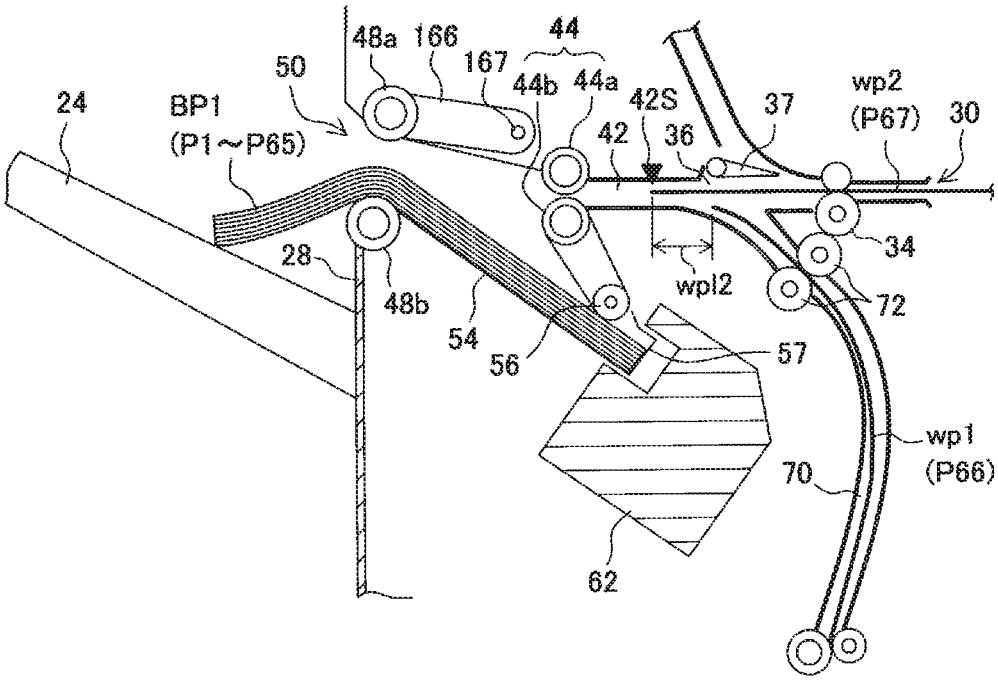

FIGS. 11A and 11B are diagrams explaining the process following the process of FIGS. 10A and 10B. As shown in FIG. 11A, the side-binding unit 62 starts side binding on the sheet bundle BP1 composed of 65 sheets mounted on the sheet tray 54. Since the $66^{th}$ sheet wp1 cannot be conveyed into the sheet tray 54, the conveyance rollers 44 keeps switching back the sheet bundle. Then, the branch rollers 72 located in the branch path 70 convey the sheet bundle downstream the branch path 70. When the branch rollers 72 nip the following sheet P3, the switching gate 37 is moved up, opening the conveyance path 42.

While the following $66^{th}$ sheet wp1 is being conveyed in the branch path 70, its rear end is detected by the sheet sensor 42S. Then, a counter (not shown) detects the distance the rear end of the sheet wp1 has moved. When it is found that the sheet wp1 has moved by distance wp12, the branch rollers 72 are stopped rotating and wait for the $67^{th}$ sheet wp2 coming.

If the sheet bundle on the sheet tray 54 as shown in FIG. 7B is thin, the branch rollers 72 are stopped when the sheet bundle is positioned at distance wp11 from the sheet sensor 42S. If the sheet bundle is thick, the branch rollers 72 are stopped when the sheet bundle is positioned at a longer distance wp12 from the sheet sensor 42S. In practice, the distance wp11 is about 1 to 2 mm, and the distance wp12 is longer than the distance wp11 by about 4 to 6 mm. Why the distance wp12 is longer will be explained later with reference to FIG. 14. Note that the distance wp11 is set in accordance with the distance the upper delivery roller 48*a* moves after the delivery rollers 48 deliver the sheet bundle from the sheet tray 54.

As shown in FIG. 11B, the sheet bundle BP 1 is bound on the sheet tray. Meanwhile, the $67^{th}$ sheet wp2 is conveyed by the feed-in rollers 34 toward the conveyance rollers 44. If the $67^{th}$ sheet, i.e., following sheet wp2, is detected by the sheet sensor 42S, it is conveyed toward the conveyance rollers 44, set off from the following sheet wp1 (i.e., $66^{th}$ sheet P66 waiting in the branch path 70) by the above-mentioned distance wp12.

In FIG. 16, the setting of this offset distance is described as "Set the sheets off by distance wp1, and make them wait (that is, making them wait in the branch path 70 (wait path))" (S60). If the sheet bundle is thick, distance wp12 longer than the distance wp11 is set. Also in the case where two or more following sheets exist, they are set off by the distance wp12. The conveyance speed of the waiting sheets is set to 650 mm/sec. At this point, the sheet bundle BP1 (composed of sheets P1 to P65) is completely side-bound on the sheet tray 54.

As seen from FIG. 11B, the distance wp12 between the following 66$^{th}$ sheet wp1 (P66) waiting in the branch path 70 and the following 67$^{th}$ sheet wp2 (P67) conveyed from the feed-in rollers has such a value that when a sheet is switched back to the sheet tray 54, the following sheet is bent in the form of inverted V. This is important for enhancing the alignment, as in the case shown in FIGS. 7A and 7B.

Figure 12A:
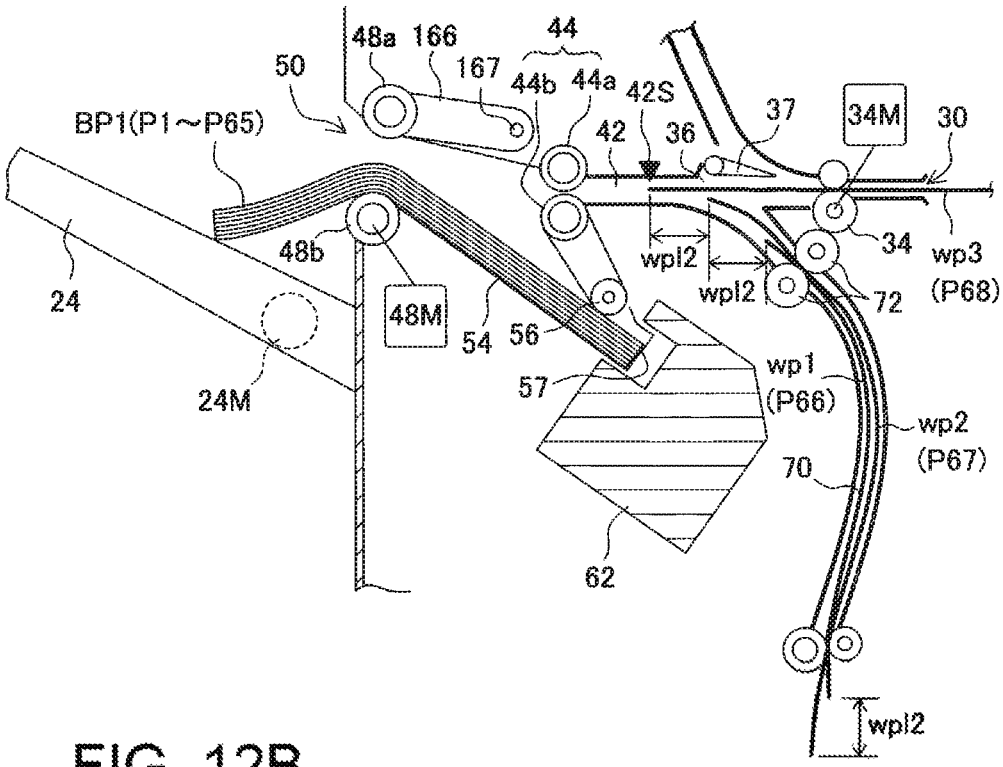
FIGS. 12A and 12B are diagrams explaining the process following the process of FIGS. 11A and 11B, FIG. 12A showing how two following sheets wp1 and wp2 wait in the branch path and how the third following sheet wp3 is guided into the branch path, and FIG. 12B showing how the delivery rollers deliver the sheet bundle BP1 from the sheet tray and how the sheet bundle BP1 is nipped and delivered together with the three following sheets wp1 to wp3.
Figure 12B:
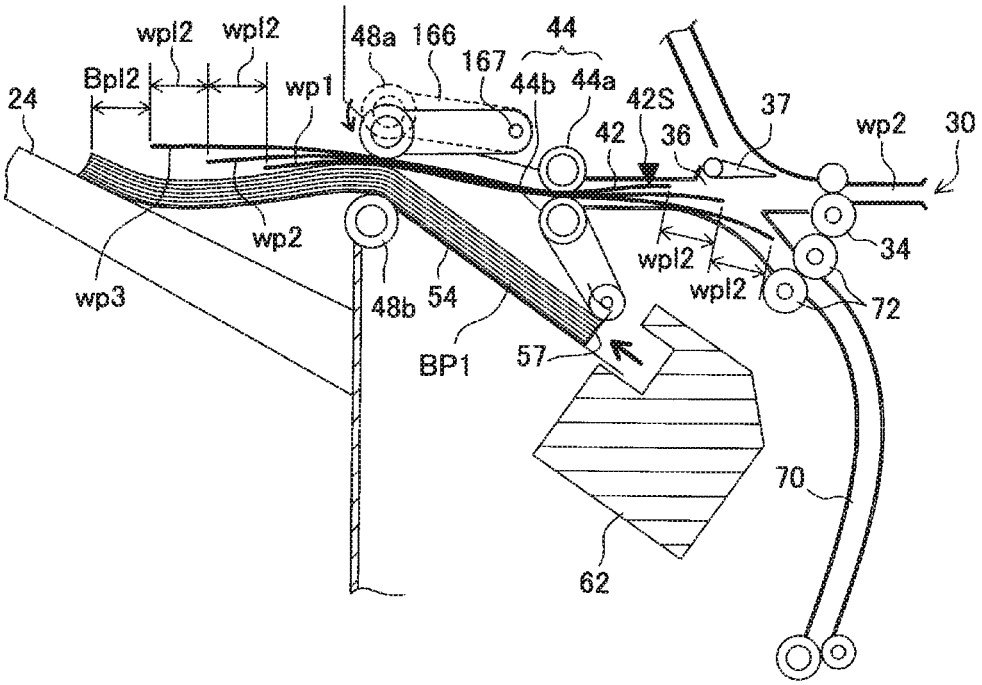

FIGS. 12A and 12B are diagrams explaining the process following the process of FIGS. 11A and 11B. FIG. 12A shows how two following sheets wp1 and wp2 (P66 and P67), respectively, wait in the branch path and how the following sheet wp3 (P68) is fed in. As shown in FIG. 11B, the following 67$^{th}$ sheet wp2 (P67) and the following 66$^{th}$ sheet wp1 (P66) waiting in the branch path 70 are conveyed to the conveyance rollers 44, with the front end of the following sheet wp2 first forwarded. The conveyance rollers 44 nip these two sheets (i.e., sheets P66 and P67) at the same time and covey them forward. When the sheet sensor 42S detects the rear end of the sheet P67, the conveyance rollers 44 are rotated counterclockwise again.

At this point, the switching gate 37 at the branch position 36 closes the feed-in path 32, guiding the two following sheets wp1 and wp2 (P66 and P67), to the branch path 70. Eventually, the sheet sensor 42S detects the rear end of the following 67$^{th}$ sheet wp2 (P67). When the sheet wp2 is conveyed to the branch path 70, set off by distance wp12, the branch rollers 72 are stopped, the sheet following 68$^{th}$ sheet wp3 (P68) is conveyed in, and the front end of the sheet wp3 will be detected by the sheet sensor 42S. FIG. 12A illustrates this state. In this state, the following sheets wp1 to wp3 are set off, one from the next, by offset distance wp12. The offset distance wp12 is longer than the offset distance wp11 set in the case where a relatively thin sheet bundle is mounted.

FIG. 12B shows how the delivery rollers 48 nip and deliver the sheets wp1 to wp3 together with the sheet bundle BP1 while making the sheets wp1 to wp3 set off from one another by distance wp12 and the sheet wp1 set off by distance Bp1 from the front end of the sheet bundle BP1 mounted on the sheet tray 54. That is, the sheet bundle BP 1 is pushed on the reference surface 57 toward the outlet port of the sheet tray 54, and the delivery rollers 48 are then lowered, nipping the sheets wp1 to wp3. The sheets wp1 to wp3 are so nipped in order to set off the front end of the uppermost following sheet wp3 from the front end of the sheet bundle BP1 by distance Bp1. The sheet bundle BP 1 set off by this distance Bp1 is delivered by the delivery rollers 48 to the first accumulating tray 24.

Since the three following sheets wp1 to wp3 have the same length, the uppermost sheet wp3, intermediate sheet wp2 and lowermost sheet wp1 extend toward the first accumulating tray 24, one from another by distance wp12, in the order they are mentioned. In other words, when they are switched back on the sheet tray 54, the uppermost sheet wp3 and the intermediate sheet wp2 are remotest and second remotest from the reference surface 57, respectively, and the lowermost sheet wp1 is nearest to the reference surface 57. This state is described in FIG. 16 as "Deliver the sheet bundle and the following sheets at the same time from the sheet tray 54 (after the alignment, side binding, and punching) (S70)".

Figure 13A:
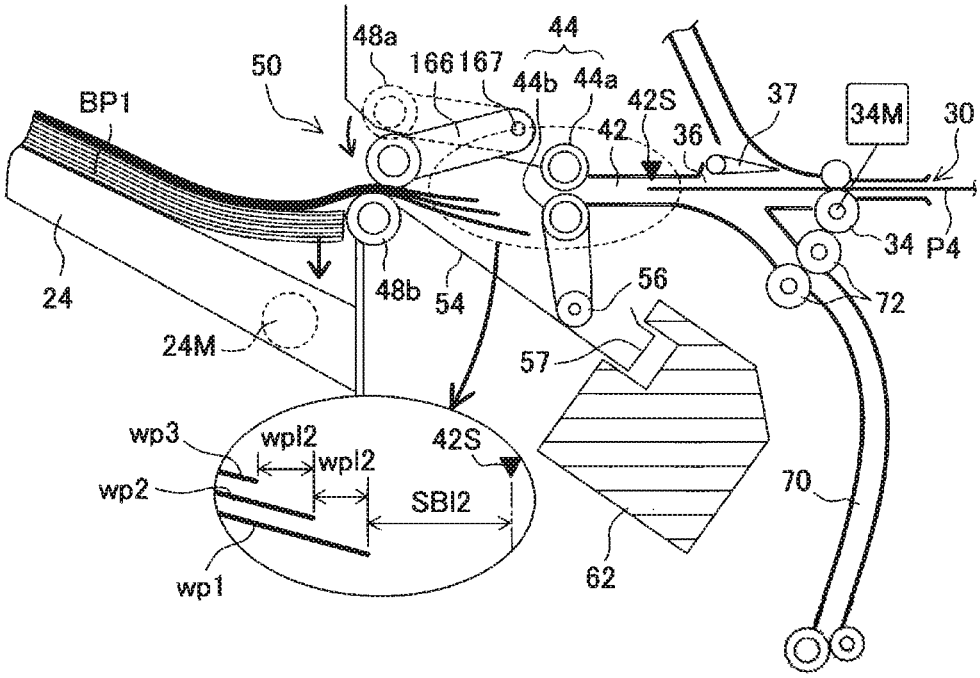
FIGS. 13A and 13B are diagrams explaining the process following the process of FIGS. 12A and 12B, FIG. 13A showing how the sheet bundle BP1 is delivered from the sheet tray and how three following sheets wp1 to wp3 left on the sheet tray start are switched back, and FIG. 13B showing the first sheet bundle BP1 mounted on the accumulating tray, the following sheets wp1 to wp3 mounted on the sheet tray, and the fourth following sheet being conveyed onto the sheet tray.
Figure 13B:
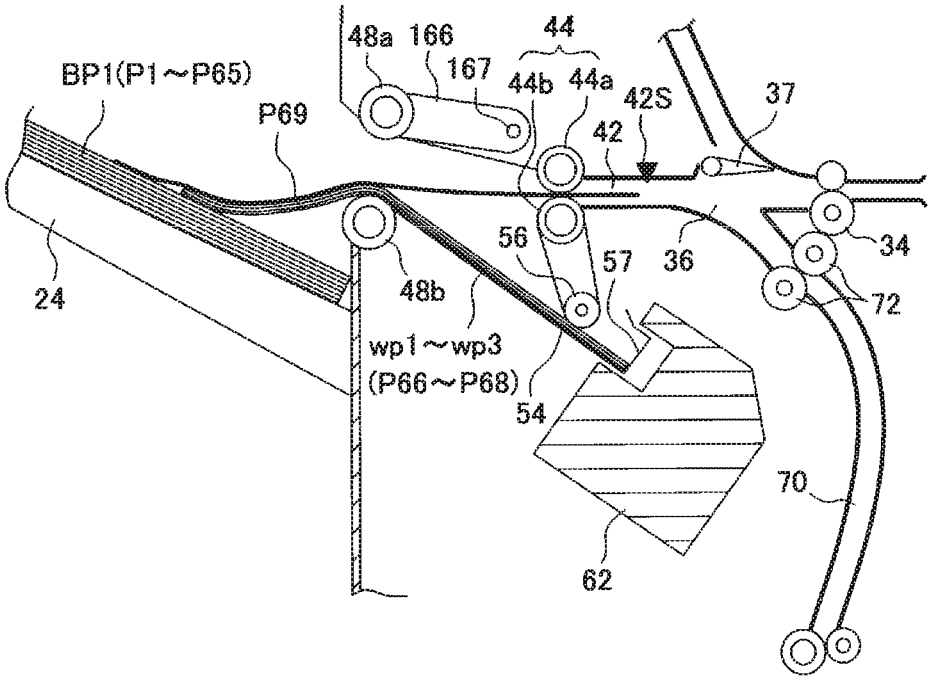

FIG. 13A and FIG. 13B following the process of FIGS. 12A and 12B show how the sheet bundle BP1 (P1 to P65) is delivered from the sheet tray and how three following sheets wp1 to wp3 left on the sheet tray 54 are switched back. As shown in FIG. 13B, the sheet bundle BP1 mounted on the sheet tray 54 and the following sheets wp1 to wp3 conveyed by the conveyance rollers 44 are simultaneously nipped and delivered by the delivery rollers 48. The sheet bundle BP1 remains on the first accumulating tray 24. The following sheets wp1 to wp3 overlapping and set off from one another by distance Bp1 remain on the sheet tray 54.

The following sheets wp1 to wp3 are set off one from another by distance Bp1 and are bent in the form of inverted V (see the enlarged part of FIG. 13A, encircled by an ellipse). In this state, the support arm shaft 167 located upstream the delivery roller 48*a* is rotated. Then, the delivery roller 48*a* rotates by a large angle after the sheet bundle BP1 is delivered, because the sheet bundle BP1 composed of 65 sheets is relatively thick. As a result, the following sheets wp1 to wp3 are set off by distance wp12 at rear end, greatly toward the reference surface 57, and remain on the sheet tray 54. The delivery rollers 48 are then rotated in the direction reverse to the sheet-delivering direction. The following sheets wp1 to wp3 are therefore switched back toward the reference surface 57.

The switch back position is so set that the sheet bundle BP1 may be delivered before the rear end of the following sheet wp1 (nearest to the reference surface 57) moves from the sheet sensor 42S by distance SB12 and the following sheets wp1 to wp3 may be switched back. The following sheets wp1 to wp3 move toward the reference surface 57 as the sheet bundle BP1 is delivered. From the distance the following sheets wp1 to wp3 so move, too, the switch back position (SB1) of the following sheets wp1 to wp3 is determined. That is, if the sheet bundle BP1 is thin as described in FIG. 9, the switch back position (SB1) is the position to which the sheet bundle BP1 moves from the sheet sensor 42S by distance SB11. If the sheet bundle BP1 is thick as in the case of FIG. 13, the switch back position (SB1) is the position to which the sheet bundle BP1 moves from the sheet sensor 42S by distance SB12 longer than distance SB11.

This state is described in FIG. 16 as "Switch back the following sheets at the switch back position (SB1) (and convey the following sheets, so switched back, by the gathering roller 56 to the reference surface)". As shown in FIG. 9B, the front ends of the following sheets wp1 to wp3 sequentially abut on, and are aligned, on the reference surface 57.

FIG. 13B shows the following sheets wp1 to wp3 abutting on the reference surface 57. The second sheet bundle BP2 (sheets P66 to P68) is mounted on the sheet tray 54. In this case, the upper delivery roller 48*a* moves to the position (indicated by solid lines) from the lower delivery roller 48*b*, allowing the 69$^{th}$ to 130$^{th}$ sheets to move onto the sheet tray 54. FIG. 13B also shows how the sheets assume the state shown in FIGS. 10A and 10B. The operation is repeated until the sheets are convey onto the sheet tray 54 in a designated number (in this case, 130, and 65 sheets on the sheet tray 54). Thereafter, the operation shown in FIG. 10A to FIG. 13B is performed. Finally, the last sheet bundle is delivered onto the first accumulating tray 24. This state is described in FIG. 16 as "Set the offset distance for the following sheets and finish conveying the sheets, and then switch back the following sheets onto the sheet tray 54".

In the process of FIG. 8A to FIG. 9B, the offset distance is wp11 for the following sheets wp1 to wp3 and the switch back position is at distance SB11 from the sheet sensor 42S if the sheet bundle is relatively thin. If the sheet bundle is relatively thick, the offset distance is wp12 for the following sheets wp1 to wp3, and the switch back position is at distance SB12 from the sheet sensor 42S. Here, offset distance wp11<offset distance wp12, and distance SB11<distance SB12. Namely, the offset distance and the switch back position at the sheet tray 54 are changed in accordance with the thickness of the sheet bundle mounted on the sheet tray 54 that is nipped together with the following sheets. This point will be confirmed with reference to FIGS. 114A, 14B and 14C.

Figure 14A:
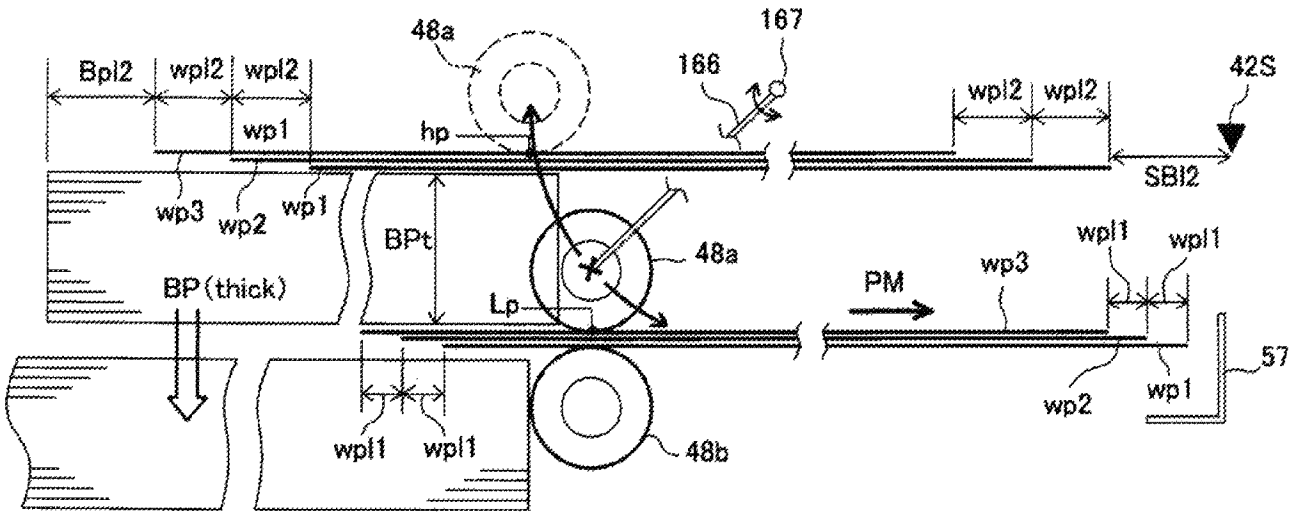
FIGS. 14A to 14C are diagrams explaining the relation between the thick sheet bundle and the following sheets, all shown in FIG. 13A, FIG. 14A showing the relation observed immediately after the sheet bundle has been delivered from the sheet tray, FIG. 14B showing how the offset distance between the following sheets increases in proportion to the thickness of the sheet bundle, and FIG. 14C showing how the offset distance between the following sheets is increased stepwise with respect to the thickness of the sheet bundle.
Figure 15:
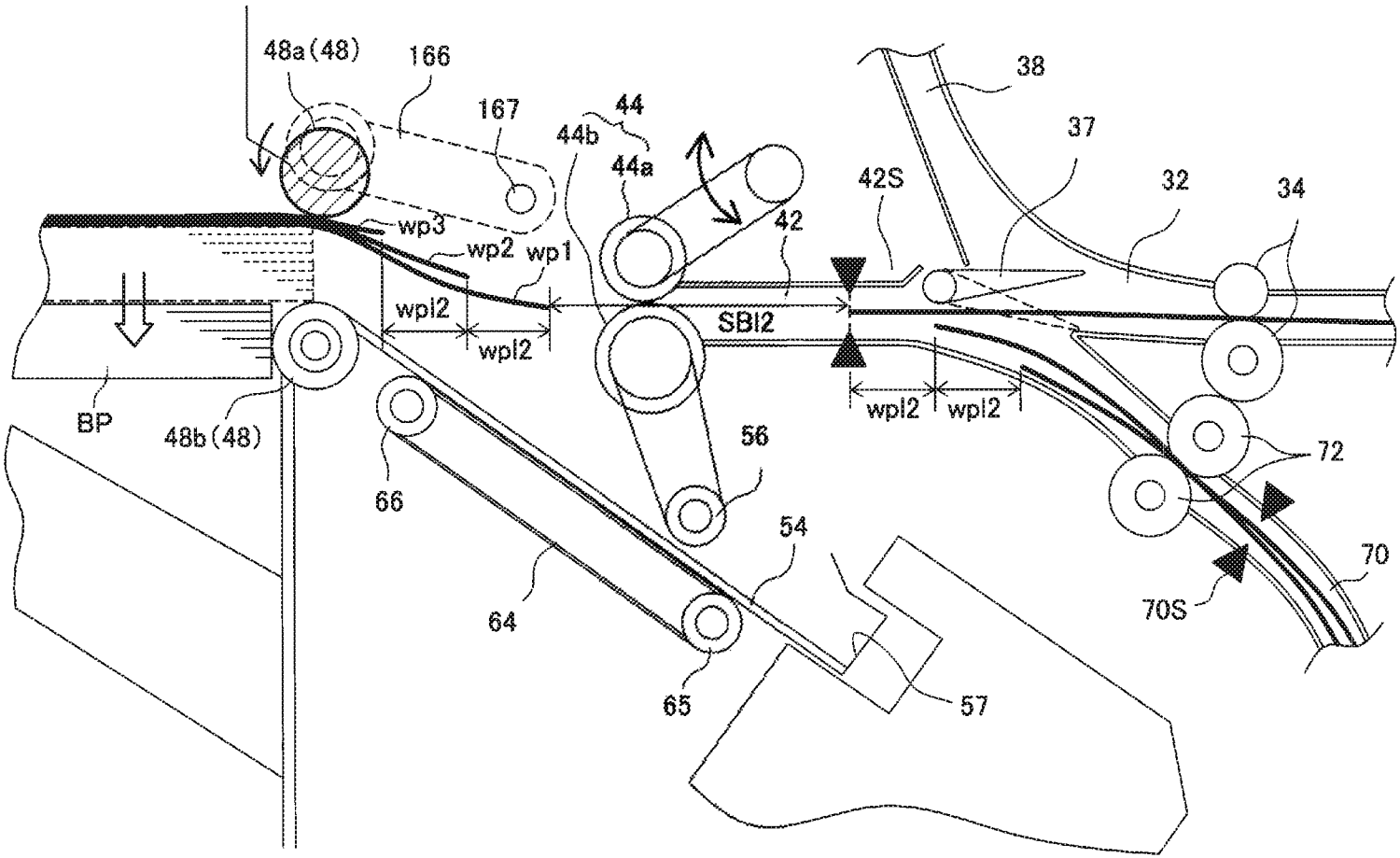
FIG. 15 is a diagram explaining the relation between a sheet following the thick sheet bundle shown in FIGS. 13A and 14A and the sheet following this sheet.

FIG. 14A shows a relatively thick sheet bundle BP (i.e., thick sheet bundle Bpt) nipped together with the following sheets wp1 to wp3 by the upper delivery roller 48*a* and lower delivery roller 48*b* immediately before it is delivered from the sheet tray 54. To deliver the sheet bundle BP from the sheet tray 54, the upper delivery roller 48*a* is rotated around by the support arm shaft 167 located above it (namely, upstream the outlet port of the sheet tray 54), and cooperates with the lower delivery roller 48*b*, nipping the sheet bundle BP for switch back.

As may be seen from FIG. 14A, the upper delivery roller 48*a* moves down from the upper position Hp spaced above the lower position Lp by the sum of the thickness Bpt of the sheet bundle BP and the total thickness of the following sheets wp1 to wp3, to the lower position Lp where the upper delivery roller 48*a* and lower delivery roller 48*b* nip only the following sheets wp1 to wp3. Since the upper delivery roller 48*a* moves down in an arc locus, it contacts the following sheet wp1 at a point in the reference surface 57 of the sheet tray 54. Consequently, unless the offset distance wp1 for the following sheets wp1 to wp3 is long enough, the following sheets wp1 to wp3 may abut on the reference surface 57 in a wrong order, and may not be aligned as desired on the reference surface 57. In view of this, the offset distance wp1 for the following sheets wp1 to wp3 is changed in accordance with the thickness of the sheet bundle BP1 mounted on the sheet tray 54.

Figure 14B:
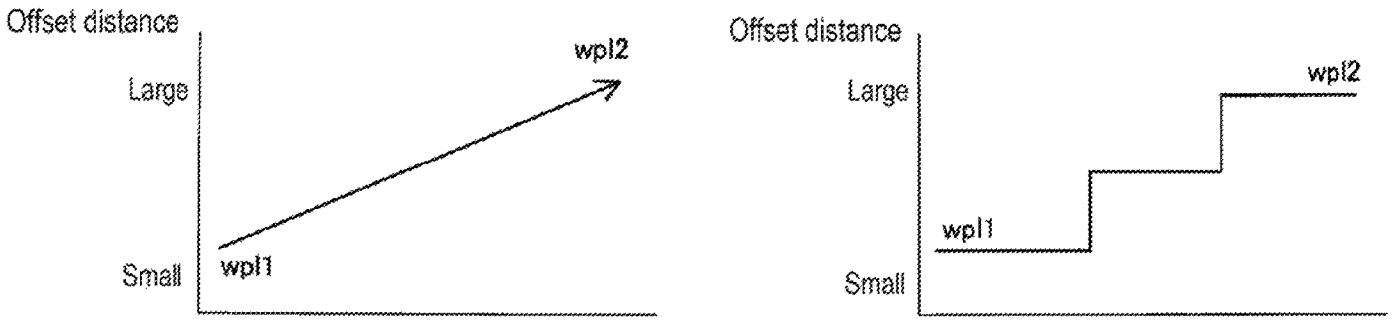
Figure 14C:
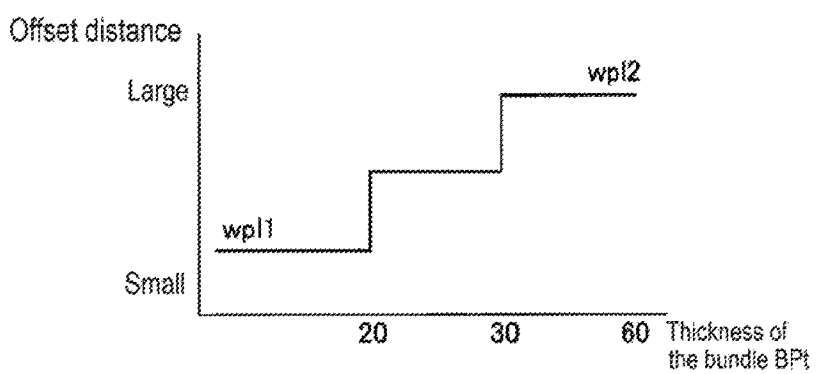

FIG. 14B and FIG. 14C show the relation between the thickness Bpt of the sheet bundle BP and the offset distance wp1 of the following sheets wp1 to wp3. More precisely, FIG. 14B shows that the offset distance wp1 of the following sheets wp1 to wp3 is gradually increased in proportion to the thickness Bpt of the sheet bundle BP, and FIG. 14C shows that the offset distance wp1 is increased stepwise in proportion to the thickness Bpt of the sheet bundle BP. If the offset distance wp1 is increased in proportion to the thickness Bpt, the following sheets wp1 to wp3 can be easily and neatly aligned on the sheet tray 54.

FIG. 15 shows the following sheets wp1 to wp3 and the switch back position, all moved from the sheet sensor 42S for the distance SB12 while the sheet tray 54 is holding a relatively thick sheet bundle. In practice, however, any following sheet never waits as shown in FIG. 15 when the sheet bundle BP is delivered. If a relatively thick sheet bundle is held on the sheet tray 54, the following sheets wp1 and wp2 having front ends set off by the distance wp12 wait in the branch path 70 as a wait path, and the following sheet wp3 is conveyed to the branch path 70 from the feed-in path 32 and is set off from the following sheet wp2 by offset distance wp12 at the position detected by the sheet sensor 42S.

The position where any sheet is switched back onto the sheet tray 54 is set at the distance SB12 from the sheet sensor 42S toward the delivery rollers 48. The following sheets wp1 to wp3 contacting the upper delivery roller 48*a* to be delivered together with the sheet bundle BP are set off by the offset distance wp12. The offset distance wp12 is longer than the offset distance wp11 by which the following sheets wp1 to wp3 to be nipped together with a relatively thin sheet bundle BP are set off. Further, the switch back position is remote from the sheet sensor 42S. At the switch back position, the following sheets may be switched back more slowly than the case where the sheet bundle is thin.

[Control System]

The image forming apparatus A incorporates a control system. The control system will be described with reference to FIG. 17 that is a block diagram. The image forming apparatus shown in FIG. 1 comprises an image-forming control section 200 and a sheet-processing control section 204 (i.e., control CPU) for controlling the sheet processing apparatus B. The image-forming control section 200 has a sheet-supplying control unit 202 and an input unit 203. The image-forming control section 200 has a control panel 18. The control panel 18 of the input unit 203 may be operated to set a "print mode" and a "sheet processing mode".

The sheet-processing control section 204 is a control CPU designed to make the sheet processing apparatus B process sheets in the sheet processing mode designated. The sheet-processing control section 204 comprises a ROM 206 storing an operation program and a RAM 207 storing control data. The sheet-processing control section 204 receives signals from a sensor-input unit 208. The sensor-input unit 208 receives signals from various sensors such as a feed-in sensor 30S configured to detect any sheet existing in the feed-in path 32, a sheet sensor 42S configured to detect any sheet existing the conveyance path 42, a branch sensor 70S configured to detect any sheet in the branch path 70, a sheet-surface sensor 24S configured to detect the surface of any sheet on the first accumulating tray 24, a sheet vacancy sensor 25 and a bundle thickness sensor 230 configured to detect the thickness of the sheet bundle mounted on the sheet tray 54.

The sheet-processing control section 204 comprises a sheet conveyance control unit 210. The sheet conveyance control unit 210 controls a feed-in roller motor 34M provided in the feed-in path 32, the conveyance roller motor 44M arranged at the conveyance path 42, the delivery roller motor 48M arranged at the outlet port of the sheet tray 54, and the arm motor 160M used to move up and down the upper delivery roller 48*a*. The sheet-processing control section 204 further comprises a punch drive control unit 211 and a sheet tray (process tray) control unit 212. The punch drive control unit 211 controls a punch motor 31M in the punching unit 31 to make holes in a sheet. The sheet tray control unit 212 controls the aligning plates 58 to align the sheets on the sheet tray 54. The sheet-processing control section 204 comprises a side-binding control unit 213 and a first accumulating-tray lift control unit 214, too. The side-binding control unit 213 controls the side-binding motor 62M of the side-binding unit 62 that binds the sides of a sheet bundle on the sheet tray 54. The first accumulating-tray lift control unit 214 controls motor 24M that can move up and down the first accumulating tray 24 in accordance with the number of sheets mounted on the first accumulating tray 24.

The sheet-processing control section 204 has a stacker control unit 216 and a saddle-binding control unit 217. The stacker control unit 216 controls the alignment plates 81 and the stopper 85 to align the sheets and stop the front end of each sheet, respectively, on the stacker 84 (i.e., second tray). The saddle-binding control unit 217 controls the saddle binder 82 that binds the sheets at the part middle in the conveyance direction.

The sheet-processing control section 204 further has a folding unit and a saddle-folding/delivering control unit 218. The folding unit folds the saddle-bound sheet bundle double and then delvers the sheet bundle to the second accumulating tray 26. The saddle-folding/delivering control unit 218 controls the folding roller, folding blade and a delivery motor 92M that drive the bundle delivering rollers 98. How these control units are connected to the various sheet sensors and various drive motors and how the sheets are conveyed and delivered have been explained above in conjunction with the function of each control unit.

[Sheet Processing Modes]

The sheet-processing control section 204 so configured as described above controls the sheet processing apparatus B, causing the same to operate in, for example, "printout mode," "side binding mode (first process)," "sorting mode (jog mode)" and "saddle binding mode." The setting of any of these processing modes is carried out by a mode setting means 201 by way of the input unit 203 of the control panel 18. The sheet processing modes will be described blow.

(1) Printout Mode

In this mode, the sheet processing apparatus B receives a sheet having an image formed on it, and the conveyance rollers 44 and delivery rollers 48 deliver the sheet onto the first accumulating tray 24.

(2) Side Binding Mode

In this mode, sheets conveyed from the outlet port 3, each having an image formed on it, are received on the sheet tray 54, aligned and bundled. The resultant bundle is side-bound at the side-binding unit 62 and mounted on the first accumulating tray 24. During the side binding, "wait conveyance" is performed, switching back the following sheets and making the following sheets wait for some time in the branch path 70, so that the delivery of the following sheets coming out of the outlet port 3 are not stopped. Further, the offset distance wp1 is set for the following sheets, and the switch back position SB1 is shifted from the sheet sensor 42S.

(3) Sorting Mode (Jog Mode)

In this mode, the sheet tray 54 receives the sheets, each having an image formed on it, from the outlet port 3 of the image forming apparatus. The sheets are held on the first accumulating tray 24 and aligned at the front or rear end by the aligning plates 58, but are not bound together.

(4) Side Binding Mode

The stacker 84 receives the sheets each having an image formed on it, from the outlet port 3 of the image forming apparatus. In the stacker 84, the sheets are aligned to form a bundle. The saddle binder 82 binds the sheets at the part substantially middle in the conveyance direction and then folds the sheets, forming a booklet. The sheets so bound are placed on the second accumulating tray 26. In the saddle binding, the sheets delivered from the outlet port 3 of the image forming apparatus are temporarily held on the first accumulating tray 24, then switched back into the branch path 70 and conveyed to the stacker 84, performing "second-tray conveyance".

As described above, the embodiment can provide an apparatus in which the offset of the following sheets can be changed in accordance with the thickness of the sheet bundle held on the sheet tray 54, to prevent sheet-alignment failure on the sheet tray 54.

Other embodiments of the invention will be described hereinafter. The second embodiment will be described with reference to FIG. 18 and FIGS. 19A and 19B. The third embodiment will be described with reference to FIG. 20 and FIGS. 21A and 21B. The components of the second and third embodiments, which are similar to those of the embodiment described above, are designated by the same reference numbers.

[Second Embodiment]

Figure 18:
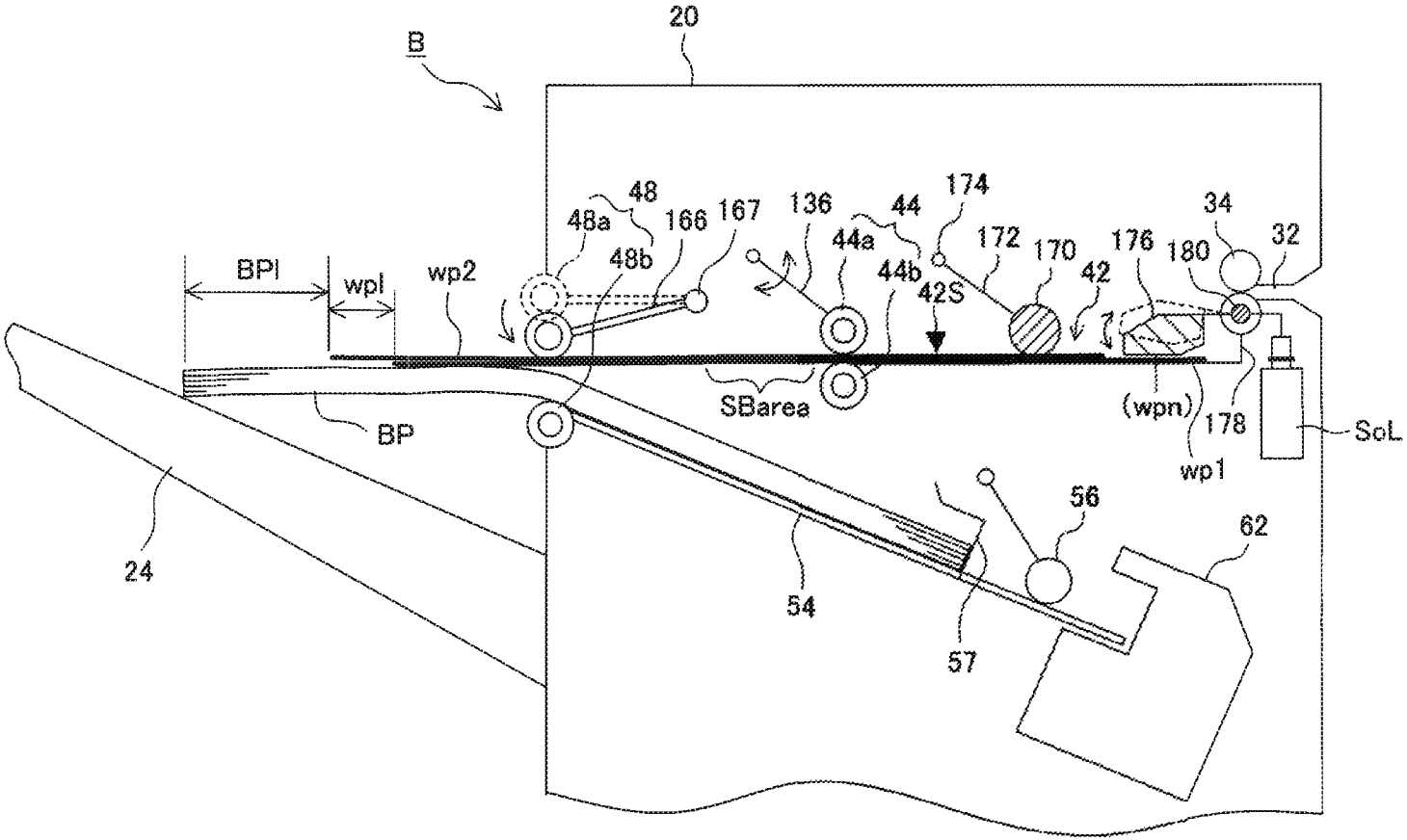
FIG. 18 is a diagram showing the configuration of a sheet processing apparatus according to the second embodiment of this invention.
Figure 22:
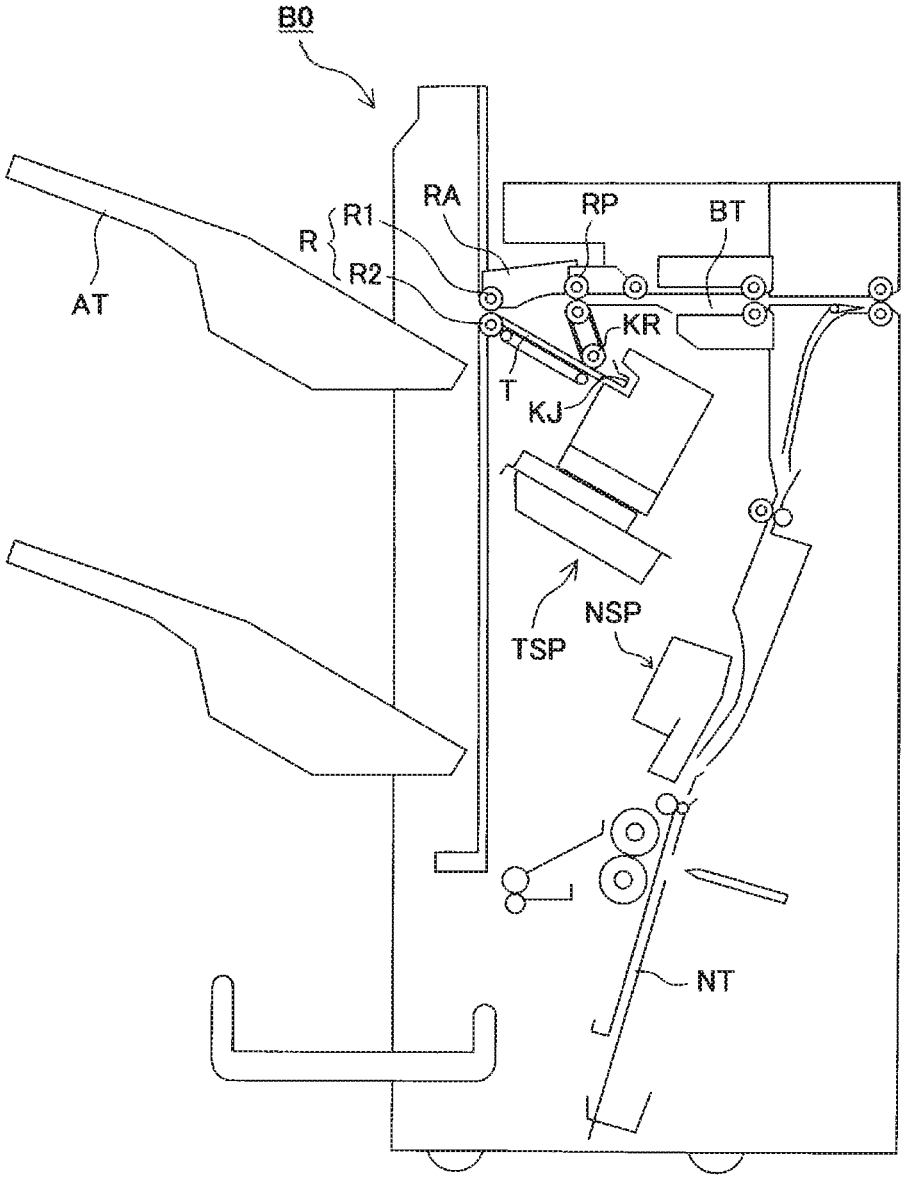
FIG. 22 is a diagram explaining a conventional sheet processing apparatus.
Figure 23A:
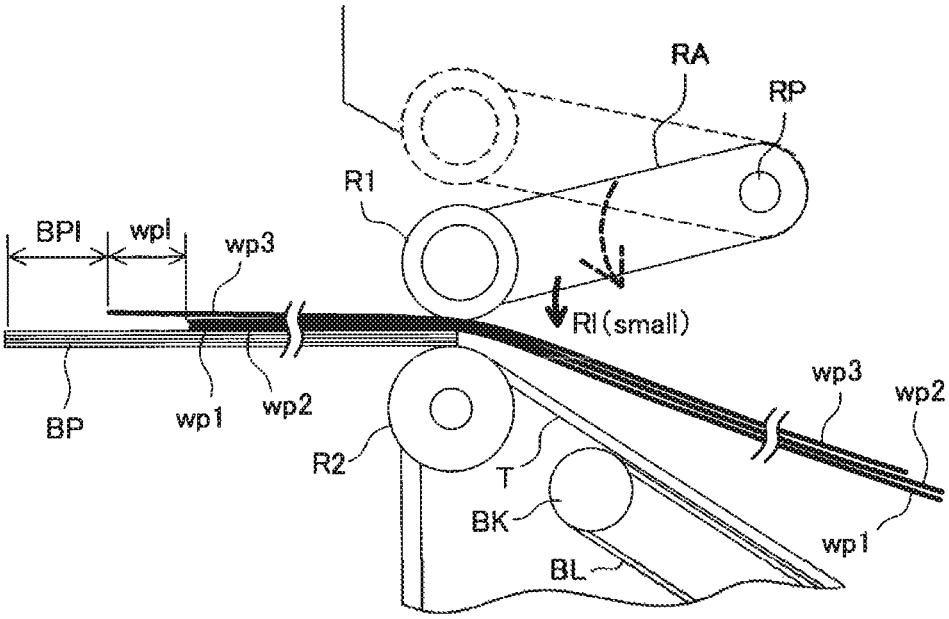
FIGS. 23A and 23B are diagrams explaining the structural features of the conventional sheet processing apparatus, which should be improved, FIG. 23A showing the state the apparatus assumes if the sheet bundle is relatively thin, and FIG. 13B showing the state the apparatus assumes if the sheet bundle is relatively thick.
Figure 23B:
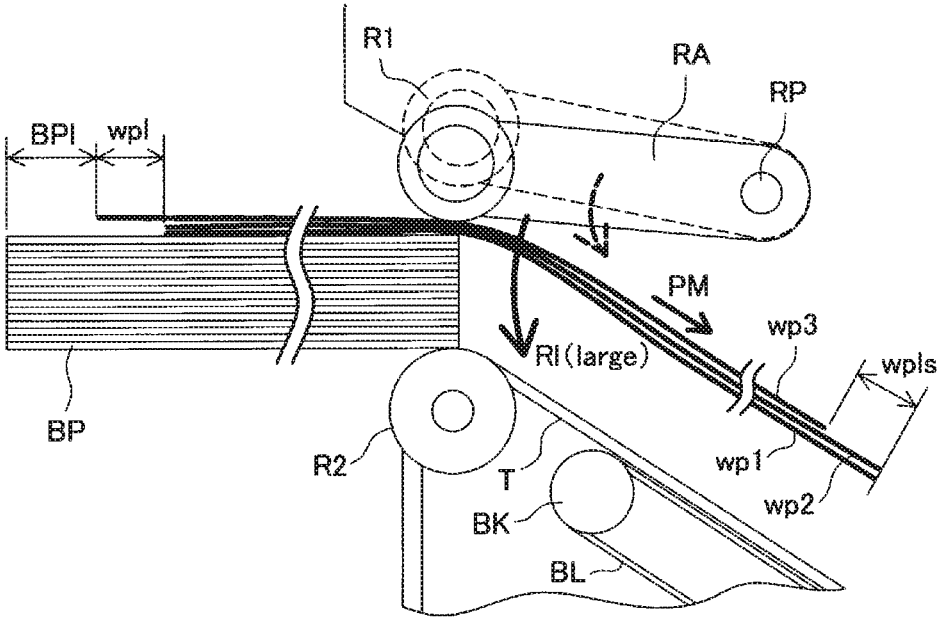

FIG. 18 shows a sheet processing apparatus B according to the second embodiment. This apparatus B has a sheet conveyance path of the type shown in FIG. 22. The apparatus B differs from the sheet processing apparatus B of the first embodiment shown in FIGS. 1 to 17 in one respect. Namely, in the apparatus B of the first embodiment, the wait path for holding the following sheets has the branch path 70 and branch rollers 72 for guiding sheets to the stacker 84 holding sheets subject to saddle-binding, whereas in the apparatus B of the second embodiment, the conveyance path 42 extending from the feed-in rollers 34 to the sheet tray 54 is comparatively long and used as wait path. In the middle part of the conveyance path 42, a wait roller 170 is provided to keep waiting the sheet switched back by the conveyance rollers 44.

The wait roller 170 is supported by a wait roller arm 172. The wait roller arm 172 is pivotally secured to the shaft 174 of the wait roller 170. Immediately after the feed-in rollers 34, a sheet holder 176 is provided to hold the end of a following sheet, preventing the following sheet from being moved by the next following sheet switched back and waiting. The feed-in rollers 34 can rotate at a solenoid SoL around a lower feed-in roller shaft 180. Right below the feed-in rollers 34, a sheet stopper 178 is positioned, functioning as a control member on which the first following sheet switched back may abut at the end.

To make two following sheets wait in the conveyance path 42, the first following sheet wp1 is held at the end near the feed-in rollers 34 and the second following sheet wp2 is positioned below the wait roller 170. Since the sheet holder 176 holds the following sheet at position (wpn), the offset distance wp1 can be set. The sheet tray 54 can be positioned and the switch back position above the sheet tray 54 can be changed in accordance with distance SB (SBarea) from the sheet sensor 42S as in the first embodiment.

[Setting of the Offset Distance between the Following Sheets in the Second Embodiment]

Figure 19A:
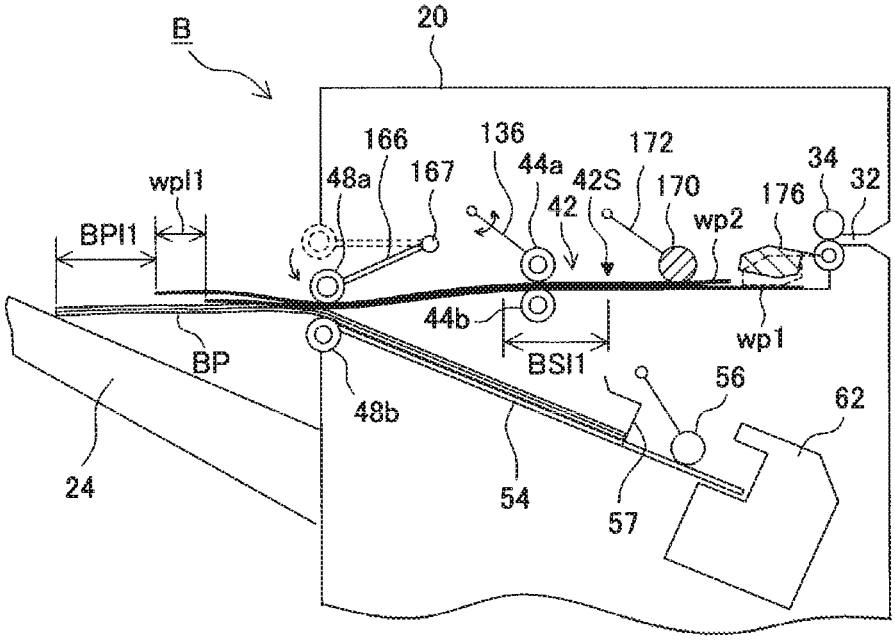
FIGS. 19A and 19B are diagrams explaining how a sheet bundle and following sheets are fed in the sheet processing apparatus shown in FIG. 18, FIG. 19A showing the case where the sheet bundle is relatively thin, and FIG. 19B showing the case where the sheet bundle is relatively thick.

How the thickness of the sheet bundle BP on the sheet tray 54 and the distance between the following sheets are changed in the sheet processing apparatus B according to the second embodiment will be explained with reference to FIG. 19A and FIG. 19B. FIG. 19A shows how a sheet bundle relatively thin and mounted on the sheet tray 54 and following sheets wp1 and wp2 are delivered at the same time by the delivery rollers 48. In this case, the sheet bundle BP is relatively thin, and the upper delivery roller 48*a* moves down for a short distance after delivering the sheet bundle BP, scarcely influencing the distance the following sheets wp1 and wp2 are set off from each other. Therefore, the following sheets wp1 and wp2 are set off from each other by distance wp11, and the switch back position is spaced from the sheet sensor 42S by distance SB11.

Figure 19B:
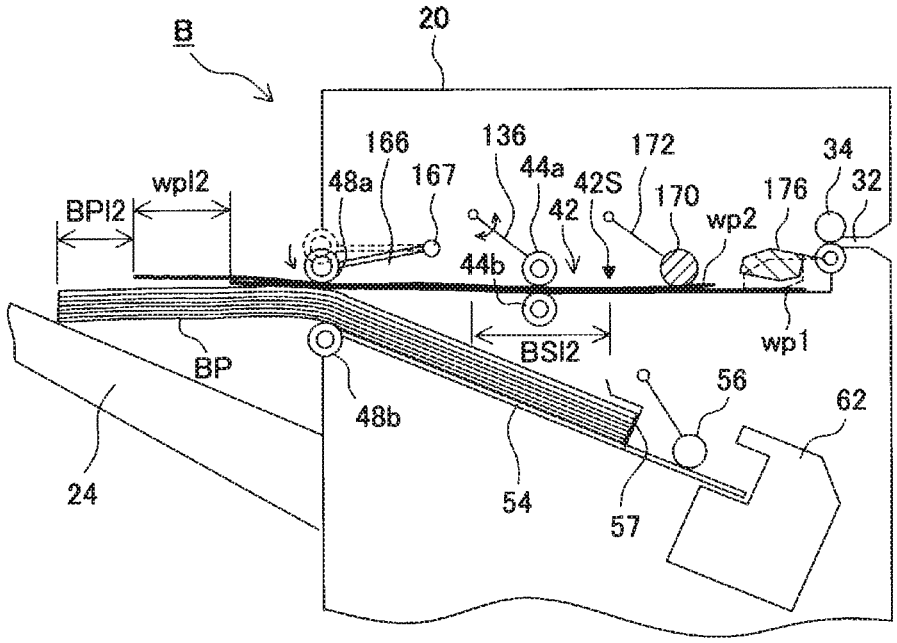

FIG. 19B shows how a sheet bundle relatively thick and mounted on the sheet tray 54 and following sheets wp1 and wp2 are delivered at the same time by the delivery rollers 48. In this case, the sheet bundle BP is relatively thick, and the upper delivery roller 48*a* moves down for a long distance after delivering the sheet bundle BP, inevitably influencing the distance the following sheets wp1 and wp2 are set off from each other. Therefore, if the following sheets wp1 and wp2 are set off by distance wp11 and the switch back position is moved by distance SB11 from the sheet sensor 42S, the following sheets move upstream the delivery rollers 48 as the upper delivery roller 48*a* is rotated counterclockwise. As a result, the following sheets are no longer set off on the sheet tray 54 or the following sheet wp2 protrudes above the reference surface 57, and the following sheets wp1 and wp2 therefore cannot be aligned at all or can be aligned but insufficiently.

In view of this, an offset distance wp12 longer than the distance wp11 is set for the following sheets wp1 and wp2 and the conveyance distance determining the switch back position is SB12 that is longer than the distance SB11. In other words, when the sheet bundle on the sheet tray 54 is thick, the switch back position between the conveyance rollers 44 and the delivery rollers 48 is set closer to the delivery rollers 48 than in the case where the sheet bundle is thin. The displacement of the following sheets wp1 and wp2 and the influence of the sheet conveyance at the switch back position are thus predicted. Therefore, the sheet processing apparatus B can align sheets well even if the upper delivery roller 48*a* is rotated greatly after the roller 48*a* has delivered the sheet bundle BP.

[Third Embodiment]

Figure 20:
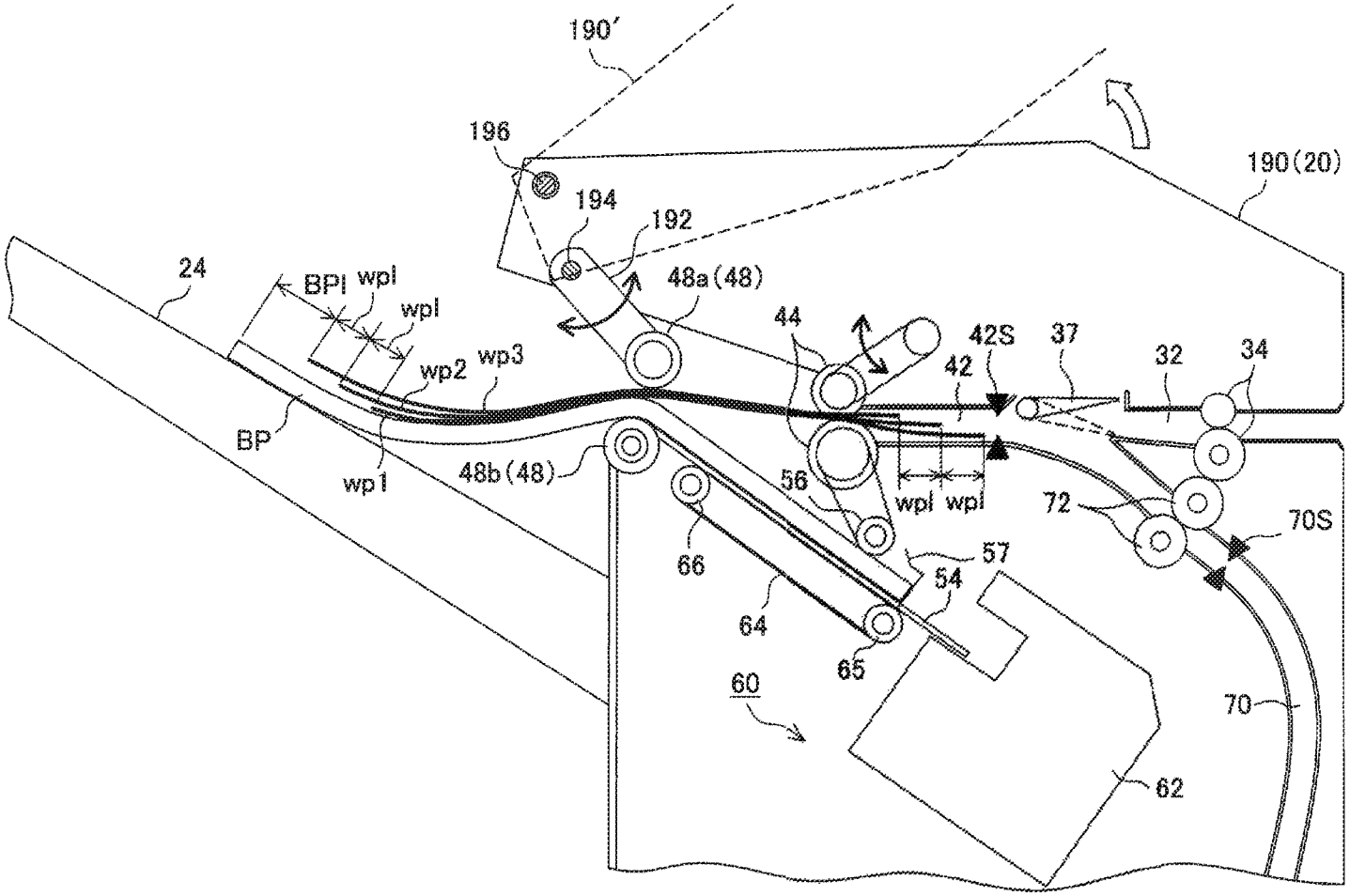
FIG. 20 is a diagram showing the configuration of a sheet processing apparatus according to the third embodiment of this invention.

FIG. 20 shows the configuration of a sheet processing apparatus B according to the third embodiment of this invention. This apparatus B differs from the first embodiment shown in FIG. 1 to FIG. 17 and the second embodiment shown in FIG. 18 and FIGS. 19A and 19B. In the first and second embodiments, the support arm shaft 167 is located upstream the upper delivery roller 48*a*, which nips and delivers, jointly with the lower delivery roller 48*b*, the sheet bundle on the sheet tray 54 together with the following sheet and delivers the sheet bundle onto the first accumulating tray 24 and the following sheet to the sheet tray 54. In the third embodiment, the support shaft 194 of the upper delivery roller 48*a* is located downstream the delivery rollers 48. In other words, the fulcrum of the upper delivery roller 48*a* is positioned below the first accumulating tray 24 in the third embodiment, whereas the fulcrum is positioned above the sheet tray 54 in the first and second embodiments.

As shown in FIG. 20, a fulcrum 196 is provided above the support shaft 194 of the upper delivery roller 48*a*. Around the fulcrum 196, an upper cover 190 can be rotated upward in the direction of the arrow to open the apparatus B. Once the upper cover 190 is so opened, the conveyance path 42 and the feed-in path 32 can be accessed. Hence, jammed sheets can be removed and the devices provided in the apparatus B can be maintained and inspected.

Also In the sheet processing apparatus B, i.e. the third embodiment, following sheets cannot be conveyed onto the sheet tray 54 while the sheet bundle BP is being bound on the sheet tray 54. Therefore, the following sheets wait in the branch path 70 as a wait path and are then nipped and delivered by the delivery rollers 48, together with the sheet bundle after completion of, e.g., binding process. Therefore, the following sheets wp1 to wp3 are set off by the offset distance wp1 from one another and by the distance BP1 from the sheet bundle BP mounted on the sheet tray 54 as in the first and second embodiments. Since the upper delivery roller 48*a* is rotated in the direction opposite to the direction it is rotated in the first and second embodiments, the delivery rollers 48 switch back and convey the following sheets wp1 to wp3 to the sheet tray 54 in the direction opposite to the direction they are switched back and conveyed in the first and second embodiments. This will be explained with reference to FIGS. 21A and 21B.

[Setting the Offset Distance Between the Following Sheets in the Third Embodiment]

Figure 21A:
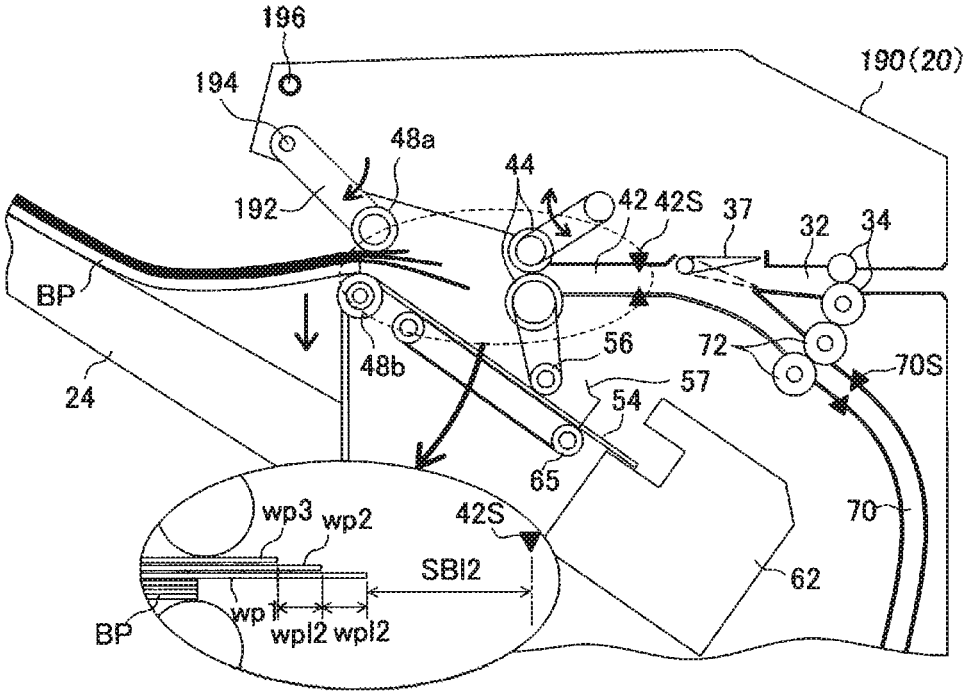
FIGS. 21A and 21B are diagrams explaining the states a sheet bundle and sheets following the bundle may take in the sheet processing apparatus shown in FIG. 20, FIG. 21A showing the state the sheet bundle and the following sheets assume if the sheet bundle is relatively thin, and FIG. 21B showing the case where the sheet bundle is relatively thick.

It will be explained how the distance between the following sheets is changed in accordance with the thickness of the sheet bundle BP mounted on the sheet tray 54 in the sheet processing apparatus B according to the third embodiment, in which the fulcrum of the upper delivery roller 48*a* is located downstream the delivery rollers 48. As shown in FIG. 21A, the delivery rollers 48 start delivering a relatively thin sheet bundle from the sheet tray 54, together with the following sheets wp1 and wp2. Since the sheet bundle on the sheet tray 54 is relatively thin and the upper delivery roller 48*a* lowers by a short distance after the sheet bundle BP is delivered from the upper delivery roller 48*a*. Hence, the upper delivery roller 48*a* does not influence the distance the following sheets wp1 and wp2 are moved. Therefore, the offset distance wp12 is set for the following sheets wp1 and wp2 as indicated in an enlarged part of FIG. 21A, encircled by an ellipse, and the switch back position is set at distance SBL2 from the sheet sensor 42S.

Figure 21B:
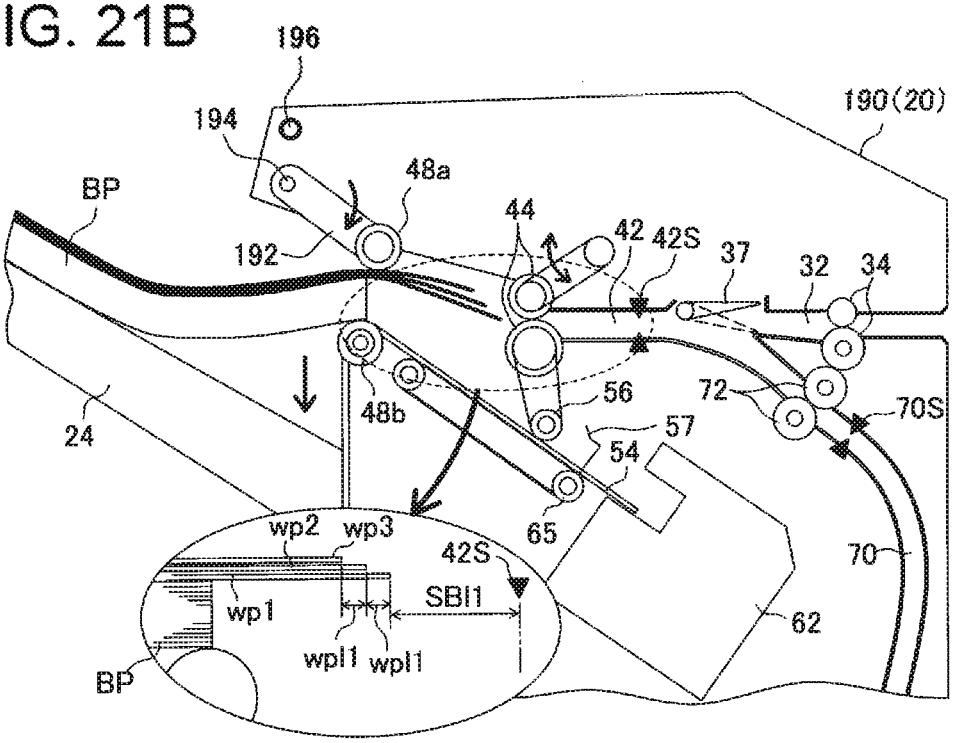

As shown in FIG. 21B, a relatively thick sheet bundle may be mounted on the sheet tray 54, and the delivery rollers 48 may start delivering the relatively thick sheet bundle from the sheet tray 54, together with the following sheets wp1 and wp2. Since the sheet bundle is relatively thick, the distance the upper delivery roller 48*a* lowers after delivering the sheet bundle BP is long, influencing the distance the following sheets wp1 and wp2 move. Hence, if offset distance wp12 is set for the following sheets sw1 and sw2 as shown in FIG. 21A and the switch back position is moved by distance SBL2 from the sheet sensor 42S, the following sheets will move downstream the delivery rollers 48 due to the rotation of the upper delivery roller 48*a* in the clockwise direction. Consequently, the following sheets wp1 and wp2 will no longer be set off from one another on the sheet tray 54, or the following sheet wp2 will not be aligned or not aligned enough.

In view of the above, the following sheets wp1 and wp2 are set off from each other by distance wp11 shorter than distance wp12. (Note, wp11<wp12, and the distance SB11 the switch back position is moved from the sheet sensor 42S is shorter than distance SB12.) In other words, the following sheets are positioned between the conveyance rollers 44 and the delivery rollers 48, closer to the conveyance rollers 44, if the sheet bundle BP on the sheet tray 54 is thick. The displacement of the following sheets wp1 and wp2 and the influence of the sheet conveyance at the switch back position are thus predicted. Therefore, the sheet processing apparatus B can align sheets well even if the upper delivery roller 48*a* is rotated greatly after the roller 48*a* has delivered the sheet bundle BP.

As has been described, in the first and third embodiments, the following sheets wp1 to wp3 can be aligned well when they are switched back to the sheet tray 54, because the delivery rollers 48 changes the distances among the sheets wp1 to wp3 in accordance the thickness of the sheet bundle laid on the sheet tray 54. When the following sheets wp1 to wp3 are switched back onto the sheet tray 54, they are aligned well, never insufficiently aligned or laid in disorder on the sheet tray 54.

The present invention is not limited to the embodiments described above. Accordingly, various modifications may be made without departing from the spirit or scope of this invention. The technical points contained in the idea described in the following claims pertain to the present invention. The embodiments described above are preferred examples. Based on the technical disclosure of the specification, any person with ordinary skill in the art may make various alternatives, modifications, changes or improvements, which are in the technical scope of the claims attached hereto.

This application is based upon and claims the benefit of priority from the prior Japanese Patent Application No.

2016-206436 filed Oct. 21, 2016, Japanese Patent Application No. 2016-206437 filed on the same day, and Japanese Patent Application No. 2016-206438 filed on the same day, the entire contents of which are incorporated herein by reference.

What is claimed is:

1. A sheet processing apparatus comprising:

conveyance rollers configured to convey sheets in a prescribed conveyance direction;

a sheet tray configured to collect the sheets conveyed from the conveyance rollers, thereby forming a sheet bundle, and to hold the sheet bundle at a prescribed position;

a wait path provided upstream in the prescribed conveyance direction of the conveyance rollers, and configured to keep waiting the following sheets conveyed by the conveyance rollers;

second conveyance rollers configured to cooperate with the conveyance rollers to make the following sheets wait in the wait path and to convey the following sheet from the wait path;

an outlet port configured to deliver the sheet bundle from the sheet tray in a prescribed direction;

an accumulating tray configured to receive the sheet bundle delivered from the outlet port;

delivery rollers configured to nip the sheet bundle mounted on the sheet tray and a plurality of following sheets including the following sheet conveyed from the wait path, while setting off the following sheets by a prescribed offset distance, to deliver the sheet bundle through the outlet port onto the accumulating tray, and to switch back the plurality of following sheets onto the sheet tray; and a conveyance member configured to convey the following sheets from the sheet tray toward the prescribed position, wherein an offset distance between the following sheets nipped together with the sheet bundle is changed in accordance with the thickness of the sheet bundle delivered by the delivery rollers.

2. The sheet processing apparatus according to claim 1, wherein the delivery rollers are supported to rotate around a fulcrum upstream the outlet port, and the thicker the sheet bundle, the longer the offset distance between the following sheets.

3. The sheet processing apparatus according to claim 2, wherein the offset distance between the following sheets is a distance between the front end of a sheet and the front end of the sheet immediately following this sheet, and is changed by the second conveyance rollers.

4. The sheet processing apparatus according to claim 3, wherein the conveyance rollers and the second conveyance rollers make the following sheets wait in the wait path, one following sheet set off from another.

5. The sheet processing apparatus according to claim 4, wherein after a sheet sensor provided upstream the conveyance rollers detects the rear end of the following sheet switched back in a prescribed direction by the conveyance rollers and then conveyed by the second conveyance rollers, the second conveyance rollers are stopped and keep the following sheets wait at a wait position in the wait path; after the sheet sensor detects the front end of the next following sheet conveyed by the conveyance rollers, the second conveyance rollers are driven to convey the following sheet waiting in the wait path to the conveyance rollers; and the wait position is changed to change the offset distance between the following sheets.

6. The sheet processing apparatus according to claim 1, wherein the delivery rollers change, in accordance with the thickness of the sheet bundle, a switch back position at which to switch back the following sheets in order to leave the following sheets on the sheet tray.

7. The sheet processing apparatus according to claim 6, wherein the switch back position is at the ends of the following sheets, which are rear in the direction the following sheets are delivered when the following sheets are switched back by the delivery rollers, and the delivery rollers move the switch back position between the conveyance rollers and the delivery rollers toward the delivery rollers as the sheet bundle becomes thicker.

8. The sheet processing apparatus according to claim 1, wherein the delivery rollers change, in accordance with the thickness of the sheet bundle, timing of switching back the following sheets into the sheet tray in order to leave the following sheets on the sheet tray.

9. The sheet processing apparatus according to claim 8, wherein the delivery rollers switch back the following sheets while the ends of the following sheets, which are rear in the direction the following sheets are delivered, remain between the conveyance rollers and the delivery rollers, and delay the timing of switching back the following sheets into the sheet tray, as the sheet bundle becomes thicker.

10. The sheet processing apparatus according to claim 2, wherein as the sheet bundle on the sheet tray becomes thicker, the delivery rollers decreases the offset distance between the rear end of the sheet bundle and the rear ends of the following sheets conveyed from the wait path.

11. The sheet processing apparatus according to claim 1, wherein the wait path is arranged downstream the second conveyance rollers and is provided, as a branch path, to convey the sheets to a second sheet tray on which a sheet bundle is formed.

12. The sheet processing apparatus according to claim 11, further comprising a side-binding unit arranged upstream the sheet tray in the direction of delivering sheets from the sheet tray and configured to bind the sides of the sheet bundle on the sheet tray, and a saddle-binding unit arranged on the second sheet tray and configured to bind the sheet bundle, at sides, on the second sheet tray.

13. An image forming apparatus comprising:

an image forming section configured to form an image on a sheet; and an sheet processing apparatus having the configuration described in claim 1 and configured to process sheets conveyed from the image forming section.

* * * * *